United States Patent [19]

Mitsuya et al.

[11] Patent Number: 5,016,680

[45] Date of Patent: May 21, 1991

[54] WEFT PROCESSING AND RELEASING APPARATUS IN A JET LOOM

[75] Inventors: Kinpei Mitsuya; Masahiko Murata, both of Kariya, Japan

[73] Assignee: Kabushiki Kaisha Toyoda Jidoshokki Seisakusho, Aichi, Japan

[21] Appl. No.: 485,330

[22] Filed: Feb. 26, 1990

[51] Int. Cl.[5] ..... D03D 47/34

[52] U.S. Cl. ..... 139/452; 139/485.1; 139/370.2

[58] Field of Search ..... 139/435.1, 452, 116.2, 139/450, 370.2

[56] References Cited

U.S. PATENT DOCUMENTS 4,815,501 3/1989 Takehance ..... 139/452 X 4,832,091 5/1989 Shaw ..... 139/452 X

FOREIGN PATENT DOCUMENTS 3264949 11/1988 Japan ..... 139/452

*Primary Examiner*—Andrew M. Falik

*Attorney, Agent, or Firm*—Brooks Haidt Haffner & Delahunty

[57] ABSTRACT

A weft processing apparatus includes a weft releasing device for releasing or detaching a leading end of a weft from the peripheral surface of a weft cheese, a fluid jetting device for moving the released weft leading end to a weft introducing port of a weft length-measuring and reserving apparatus, and a guide device for guiding the weft leading end and the jetted fluid stream. The weft releasing device is in the form of a blow nozzle device or a suction pipe. In the former case, the blow nozzle device serves also as the fluid jetting device. The suction pipe has an intake port provided with a holding member such as a net or brush for temporarily holding the weft in a congregated state.

18 Claims, 17 Drawing Sheets

WEFT PROCESSING AND RELEASING APPARATUS IN A JET LOOM

BACKGROUND OF THE INVENTION

1. Field of the Invention

The present invention relates to a weft processing apparatus for guiding the leading end of a weft fed from a weft supply source in the form of a cheese to a weft winding type weft length-sizing and reserving apparatus when a weft feed failure such as breakage of the weft occurs between the weft cheese and the weft length-measuring and reserving apparatus or when a weft of a new cheese is to be used upon exhaustion of the weft cheese used till then.

2. Prior Art

A weft processing apparatus of the type mentioned above is disclosed, for example, in Japanese Laid-Open Patent Application No. 264949/1988 (JP-A-63-264949). In the disclosed apparatus, a suction guide tube of a conical configuration is set at a suction position in the vicinity of the peripheral surface of a weft cheese for drawing out by suction the leading end of a weft from the weft cheese and is then displaced to a stand-by position far away from the weft cheese, wherein the leading end of the weft being held under suction is inserted into an introducing port of the winding type weft length-measuring and reserving apparatus. The leading end of the weft sucked by the suction guide tube and positioned at the introducing port is then inserted into the introducing port under the sucking action thereof to be thereby threaded into and through the weft length-measuring and reserving apparatus. In this manner, the suction guide tube is changed over between the sucking position where it encloses the weft cheese and the stand-by position far away from the weft cheese.

Since the prior art apparatus is of such a structure that the drawing-out of the leading end of the weft from the cheese and the introduction of the weft drawn out to the introducing port of the weft length-measuring and reserving apparatus are performed by using one and the same suction guide tube, the latter is restricted in respect to the configuration size and the location for installation and thus suffers from a problem that the freedom in design is seriously limited. For example, the sucking position of the suction guide tube has to be set so as to match with the full bobbin weft cheese. Consequently, when failure occurs in the course of feeding a weft under the condition that the diameter of the weft cheese has been decreased smaller than that of the full bobbin cheese, the sucking position of the suction guide tube will no longer be optimal for the weft cheese of concern. As a result, the sucking action of the suction guide tube becomes lowered particularly when the weft cheese has been reduced in the diameter, giving rise to the unwanted possibility that the drawing-out of the leading end of the weft from the weft cheese results in failure. Also, the structure of the apparatus is inevitably more complicated because of the necessity for moving the suction guide tube toward the weft length-measuring and reserving apparatus in order to introduce the weft leading end into the introducing port of the weft length-measuring and reserving apparatus.

Further, it is noted that the leading end of the weft sucked by the suction guide tube lies in a linear form. In this conjunction, it is clear that the area presented by the weft of a linear form and subjected to the action of a transporting air flow such as suction or blowing is very small. Consequently, displacement of the linear weft to another place or location under the action of the transporting air flow lacks in reliability.

SUMMARY OF THE INVENTION

Accordingly, a general object of the present invention is to provide a weft processing apparatus which can guide the leading end of a weft from a weft supply source to a weft length-measuring and reserving apparatus with a significantly improved reliability.

Further, a primary object of the present invention is to provide a weft processing apparatus which is capable of drawing out with a high reliability the leading end of a weft from a weft cheese regardless of its diameter.

Another object of the present invention is to provide a weft processing apparatus which is capable of drawing out the leading end of a weft from a weft cheese and transferring it to a weft length-measuring and reserving apparatus by utilizing a transporting or carrier fluid flow.

According to a general aspect of the present invention, a weft processing apparatus for a jet loom is provided, which comprises means for releasing the leading end of a weft from a peripheral surface of a weft cheese, means for jetting a fluid to move the released leading end of the weft to a weft introducing port of a weft length-measuring and reserving apparatus by the jetted fluid, and means for guiding the travel of the leading end of the weft toward the weft introducing port together with the jetted fluid into the weft introducing port.

The leading end of the weft drawn out from the peripheral surface of a weft cheese by the weft releasing means is moved to the weft introducing port of the weft length-measuring and reserving apparatus by the fluid jetting means in cooperation with the guide means to be thereby placed in the weft introducing port. In this way, the drawing-out of the weft from the weft cheese as well as insertion of the weft into the weft introducing port can be accomplished substantially without fail.

In a preferred embodiment of the present invention, the weft releasing means is constituted by suction means in the form of a suction pipe through which a suction air flow is generated, wherein the suction pipe has a suction opening or port which is preferably provided with weft holding means such as a net, brush or the like for holding the weft in a congregated state for the purpose of allowing the weft held temporarily in the congregated state to be moved to the introducing port through the medium of a fluid jetted from the fluid jetting means. When the leading end of the weft is to be drawn out from the weft cheese, the weft congregating and holding region of the weft holding means is disposed at a weft receiving position located in the vicinity of the weft cheese so that the leading end of the weft is received by the weft congregating and holding means from the weft cheese. When the weft congregating and holding region of the weft holding means now holding the weft leading end is changed over to a stand-by position, the congregated weft leading end undergoes the transporting action of the fluid jetting means, whereby the weft held in the congregated state at the weft congregating and holding area is moved or carried to the weft introducing port by the jetted fluid.

In another embodiment of the present invention, a blow nozzle is used for serving as both the weft releasing means and the fluid jetting means. By blowing the air stream jetted from the blow nozzle onto the peripheral surface of the weft cheese, the weft leading end is detached from the peripheral surface of the weft cheese regardless of whether the diameter of the weft cheese is large or small. The leading end of the weft thus detached from the peripheral surface of the weft cheese is placed in the weft introducing port of the weft length-measuring and reserving apparatus by the fluid jetted from the blow nozzle. In that case, the guide means should preferably be constituted by a cover means which encloses substantially a whole weft path extending between the weft cheese and the weft introducing port.

BRIEF DESCRIPTION OF THE DRAWINGS

A more detailed understanding of the invention may be had from the following description of preferred embodiments thereof, given by way of example and to be read and understood in conjunction with the accompanying drawings, in which.

DETAILED DESCRIPTION OF THE PREFERRED EMBODIMENTS

Figure 1:
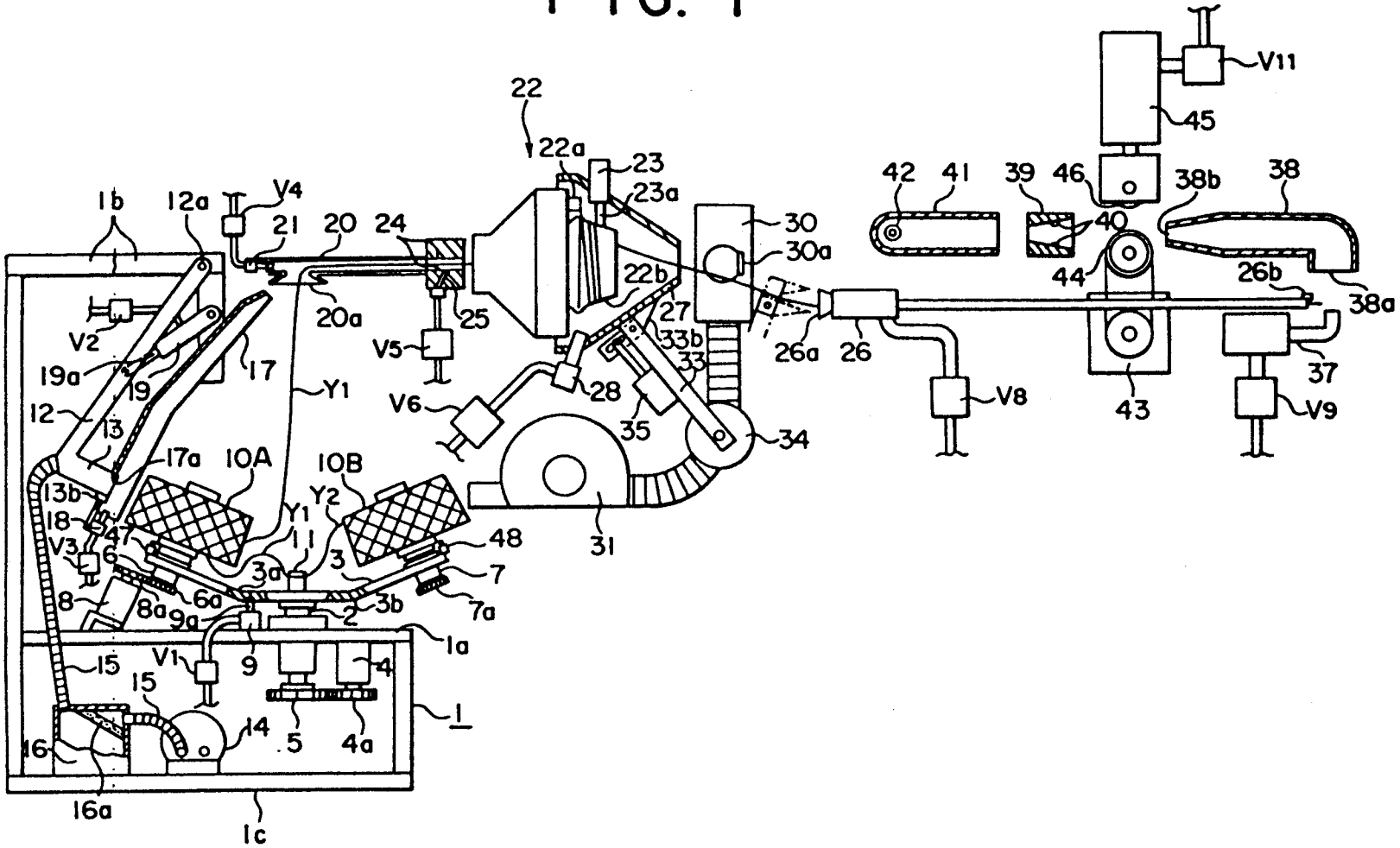
FIG. 1 is a side elevational view showing, partly in section, how a weft is guided during operation of a jet loom provided with a weft processing apparatus according to an exemplary embodiment of the invention.

Referring to the drawings, there is shown in FIGS. 1 to 11 a first embodiment incorporating the present invention. In FIGS. 1 to 11, disposed on a lateral side of a frame structure (not shown) of a weaving machine or loom is a weft feeder frame assembly 1 having an upper frame 1*a* on the top surface of which a supporting shaft 2 is rotatably mounted in an upstanding position. A turn table 3 is supported by the supporting shaft 2 at a top end portion thereof. Mounted on the upper frame 1*a* at the lower side thereof is an electric motor 4 having an output shaft on which a driving gear 4*a* is mounted and adapted to mesh with a driven gear 5 which is mounted on the supporting shaft 2 at a bottom end portion thereof. Thus, the turn table 3 can be rotated by energizing the motor 4.

A pair of bobbin holding brackets 6 and 7 are rotatably supported on the turn table 3 at angularly symmetrical positions with an angular difference of 180° therebetween. These bobbin holding brackets 6 and 7 have respective lower end portions on which driven gears 6*a* and 7*a* are fixedly mounted, respectively. An electric motor 8 is mounted on the top surface of the upper frame 1*a* of the weft feeder frame assembly 1 and has an output shaft on which a driving gear 8*a* is mounted at a position lying on a circular path along which the driven gears 6*a* and 7*a* are revolved as the turn table 3 is rotated. An air cylinder 9 is mounted on the upper frame 1*a* in an upstanding position below and within a radial extension of the turn table 3 in such an arrangement in which the tip end of a cylinder rod 9*a* of the air cylinder 9 can be moved to intersect with or away from the lower surface of the turn table 3. The air cylinder 9 is connected to a pressurized air supply tank (not shown) by way of a three-way type electromagnetic valve $V_1$.

Formed on the lower surface of the turn table 3 are a pair of positioning recesses 3*a* and 3*b* at angularly symmetrical positions with an angular difference of 180° therebetween so as to be each engageable with the free end portion of the rod 9*a* of the air cylinder. In the state in which the rod 9*a* engages the positioning recess 3*a*, the driving gear 8*a* meshes with the driven gear 6*a*, while in the state which the rod 9*a* engages in the positioning recess 3*b*, the driving gear 8*a* meshes with the driven gear 7*a*. When the electric motor 8 is actuated in the state in which the driving gear 8*a* meshes with the driven gear 6*a*, a weft cheese 10A supported on the bobbin holding bracket 6 is caused to rotate, while upon actuation of the motor 8 when the driving gear 8*a* meshes with the driven gear 7*a*, a weft cheese 10B supported on the bobbin holding bracket 7 is caused to rotate.

Installed at positions in the vicinity of the bobbin holding brackets 6 and 7 are winding diameter sensors 47 and 48, respectively, each of which may be constituted by a reflection type photoelectric sensor, for the purpose of detecting the presence or absence of the weft cheeses 10A and 10B on the bobbin holding brackets 6 and 7, respectively.

In FIG. 1, a reference numeral 11 denotes a tail holder for holding a trailing end of a weft $Y_1$ of the weft cheese 10A and a leading end of a weft $Y_2$ of the weft cheese 10B.

A pair of upstanding supporting brackets 1*b* are disposed at lateral sides of the weft feeder frame assembly 1. Supported between these supporting brackets 1*b* at free end portions thereof is a suspended suction arm 12 rotatable about a supporting shaft 12*a*. The suction arm 12 has an end portion located remotely from the supporting shaft 12*a* which is formed formed integrally with a weft releasing suction pipe 13 so as to rotate together with the suction arm 12. The rotational radial path or trajectory along which the suction pipe 13 is moved is so established as to intersect with a peripheral surface of the weft cheese (10A in the case of the illustrated embodiment) at the side where the electric motor 8 is located. Mounted at the suction opening or intake port of the suction pipe 13 is a net 13*a* for temporarily holding the weft in a congregated state with a roller 13*b* being disposed in the vicinity of the net 13*a*, as can best be seen in FIG. 5. Installed on a bottom frame 1*c* of the weft frame assembly 1 is a blower 14 to which a base end portion of the suction pipe 13 is connected by way of a hose 15, a dust box 16 and a filter 16*a*.

Further supported on the supporting brackets 1*b* at the free end portions is a suspended channel-like transporting guide 17 which serves to guide a weft and which extends downwardly to a base end or bottom of the weft cheese at the side where the electric motor 8 is located. A window or notch 17*a* is formed in the transporting guide 17 at the bottom end portion thereof at a depth reaching the innermost surface of the guide 17 with such a positional relation to the rotational trajectory of the free end portion of the suction pipe 13 and thus the net 13*a* that the window 17*a* is generally aligned with the intake port of the suction pipe 13, and the suction pipe 13 can swing into and out of the window 17*a*. Further, mounted on the transporting guide 17 at the base or bottom end portion is a blow nozzle 18 which serves to move the weft with the aid of air jet. To this end, the blow nozzle 18 is fluidly communicated with the pressurized air supply tank (not shown) by way of a two-way type electromagnetic or solenoid valve $V_3$. The jet direction of the blow nozzle 18 is oriented along the innermost surface of the transporting guide 17 so that the jet stream from the blow nozzle 18 is directed upwardly along the transporting guide 17.

Mounted on the top end portion of the supporting bracket 1*b* is an air cylinder 19 which has a driving rod 19*a* connected to the suction arm 12 and which is communicated with the pressurized air supply tank through a three-way solenoid or electromagnetic valve $V_2$. When the electromagnetic valve $V_2$ is deenergized, the driving rod 19*a* projects from the air cylinder 19. As a result, the suction arm 12 is held at a stand-by position shown in FIG. 1. In this stand-by position, the position of the net 13*a* coincides with that of the window 17*a* formed in the transporting guide 17. Upon energization of the solenoid valve $V_2$, the suction arm 12 is swung downwardly about the supporting shaft 12*a* under the action of gravity, whereby the roller 13*b* is brought into contact with the peripheral surface of the weft cheese.

Further, for the purpose of guiding the weft, a weft insertion guide 20 is horizontally disposed above the weft feeder frame assembly 1 in such an orientation as to orthogonally intersect with the axis of rotation of the turn table 3. A blow nozzle 21 is disposed at one end portion of the weft inserting guide 20 and is communicated with the pressurized air supply tank through a two-way electromagnetic valve $V_4$. The weft inserting guide 20 has a bottom surface formed with an introducing or inlet port 20*a* which is disposed at a position where the axes of the paired bobbin holding brackets 6 and 7 and the axis of rotation of the turn table 3 intersect with one another. The top end of the transporting guide 17 is directed toward the introducing port 20*a*.

Installed immediately before the weft inserting guide 20 is a known winding type weft length-measuring and reserving apparatus generally denoted by 22, which is provided with a weft winding tube 22*a* adapted to be rotationally driven by a motor M (refer to FIG. 10) provided separately from a loom driving motor (not shown). The weft is delivered from the weft winding tube 22*a*, as it rotates, to be wound around a weft winding surface 22*b*. On the other hand, delivery of the weft from the weft winding surface 22*b* is controlled by a retainer pin 23*a* which is adapted to be pulled out or in by an electromagnetic coil assembly or solenoid 23. Installed in association with a weft introducing member 22*c* communicated with the weft winding tube 22*a* are a weft breakage sensor 24, which may be constituted by a transmission type photoelectric sensor, and a weft inserting blow nozzle 25 which is communicated with the pressurized air supply tank by way of a two-way type electromagnetic valve $V_5$. The jet stream from the weft inserting blow nozzle 25 is directed from the weft winding tube 22*a* communicated with the weft introducing member 22*c* of the weft length-measuring and reserving apparatus 22 toward a weft inserting main nozzle 26.

There are mounted on a guide duct 27 having a convergent configuration and supporting the electromagnetic solenoid 23 a plurality of weft removing blow nozzles 28 each adapted to discharge a jet of air oriented towards the weft winding surface 22*b*. The jet streams from the weft removing blow nozzles 28 sweep the weft winding surface 22*b* in such a manner that the weft wound on the weft winding surface 22*b* can be removed therefrom when the retainer pin 23*a* is positioned away from the weft winding surface 22*b*. The weft removing blow nozzles 28 are connected to the pressurized air supply tank through respective two-way type electromagnetic valves $V_6$.

Figure 2:
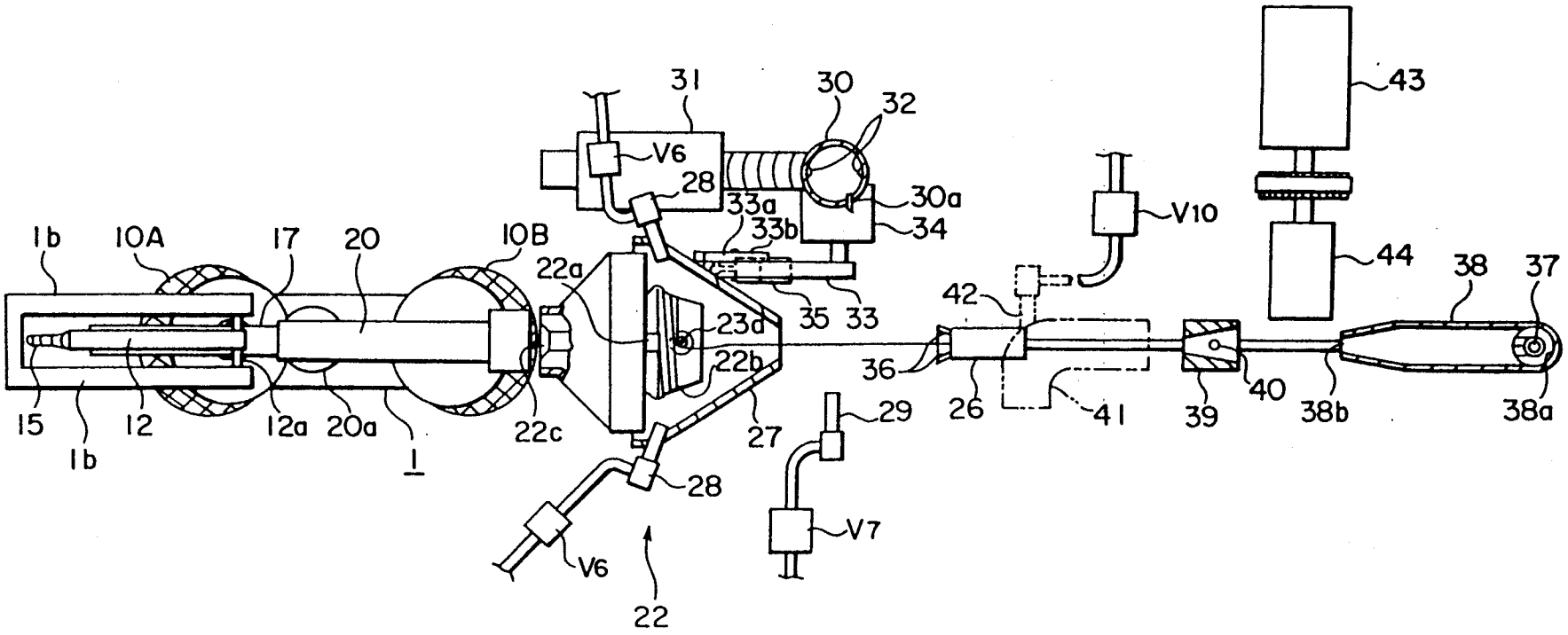
FIG. 2 is a plan view showing, partly in section, the loom shown in FIG. 1.
Figure 3:
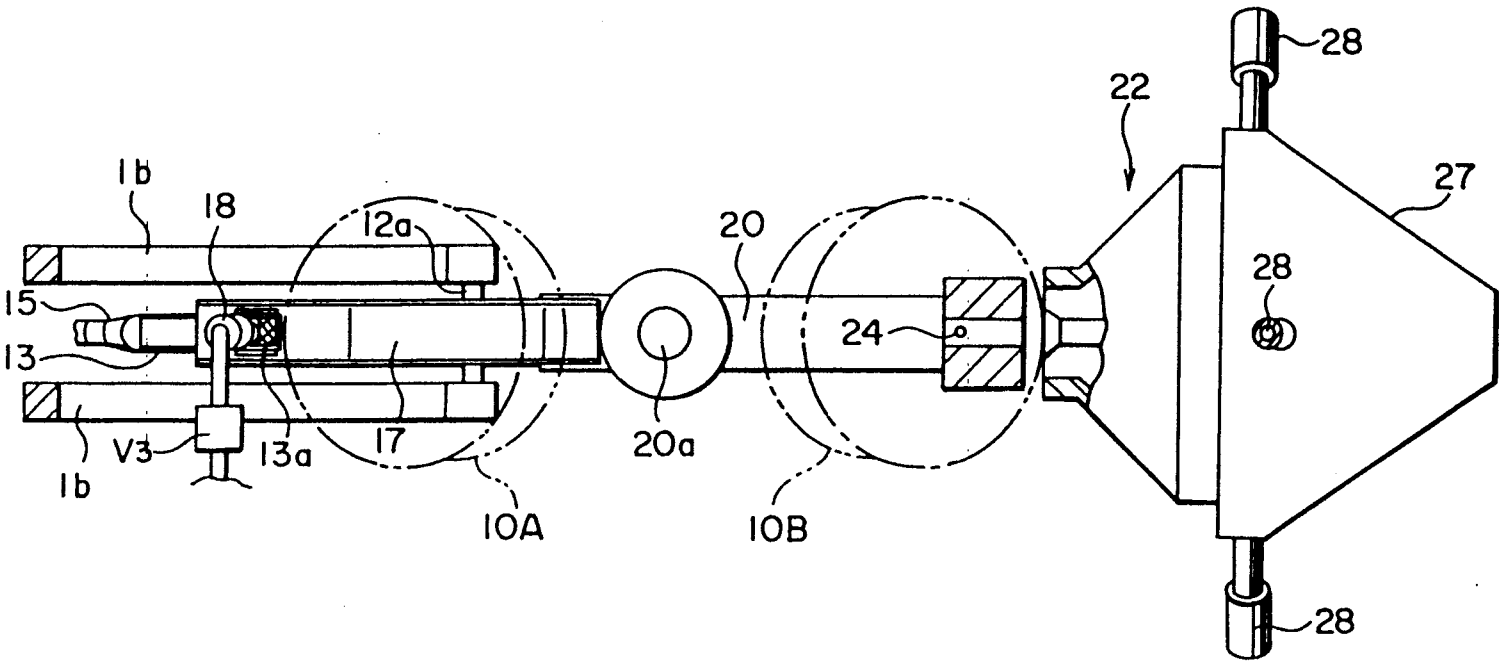
FIG. 3 is a bottom plan view showing, partly in section, a main portion of the loom shown in FIG. 1.

Referring to FIG. 2, disposed at a location immediately succeeding to a reduced-diameter opening of the converging guide duct 27 are a blow nozzle 29 and a suction pipe 30 in opposition to each other across the weft path. The blow nozzle 29 is connected to the pressurized air supply tank through a two-way type electromagnetic valve $V_7$ while the suction pipe 30 is connected to a blower 31. Mounted stationarily at the entrance of the suction pipe 30 is a cutter blade 30*a*. A weft detector 32 which may be constituted by a transmission type photoelectric sensor is provided within the suction pipe 30.

An arm 33 is installed adjacent to the suction pipe 30 in a manner to allow the arm 33 to be rotated or swung by means of an electric motor 34. A stationary gripper 33*a* is mounted at the free end of the arm 33. Additionally, a movable gripper 33*b* is rotatably supported on the free end portion of the arm 33 so as to be brought into contact with the stationary gripper 33*a* and is operatively connected to an electromagnetic coil or solenoid 35. Both the grippers 33*a* and 33*b* are normally in the open state. However, when the electromagnetic solenoid 35 is energized, the path region defined by both the grippers (hereinafter referred to as the weft gripper) intersects with the region defined between the blow nozzle 29 and the suction pipe 30 and is disposed in the vicinity of the entrance 26*a* of the weft inserting main nozzle 26.

A weft breakage sensor 36 comprising a transmission type photoelectric sensor is installed within the entrance 26*a* of the weft inserting main nozzle 26. Additionally, a stationary blade member or cutter 26*b* is mounted on the weft inserting main nozzle 26 at the tip end thereof so as to project slightly beyond the latter.

A blow nozzle 37 is installed immediately below the weft inserting main nozzle 26 in such an orientation in which the jet direction of the former intersects with the path of the jet air stream from the weft inserting main nozzle 26. A weft introducing duct 38 is installed immediately above the weft inserting main nozzle 26 and has an entrance 38*a* or which is positioned opposite to the jet orifice of the blow nozzle 37 across the jet path of the weft inserting main nozzle 26 and an exit or outlet 38*b* which is directed toward the downstream side of the weft inserting main nozzle 26.

An air guide 39 is installed downstream of the exit 38*b* and has an tapered inner passage at which a weft detector 40 constituted by a transmission type photoelectric sensor is mounted. Installed downstream of the air guide 39 is a suction pipe 41 having an exit portion bent toward a dust box (not shown). A blow nozzle 42 is connected to the bent portion of the suction pipe 41 so as to be directed toward the dust box.

The weft inserting main nozzle 26, blow nozzle 37, weft introducing duct 38, air guide 39 and suction pipe 41 are all mounted on a sley so as to be movable as a unit, accompanying the swinging movement of the sley. Disposed downstream of the region where the above-mentioned members 26, 37, 38, 39 and 41 are swung is a weft receiving motor 43 to which a driving roller 44 is operatively connected. Installed immediately above the driving roller 44 is an air cylinder 45 having a driving rod on which a driven roller 46 is rotatably supported in opposition to the driving roller 44 so that the former can be pressed against the latter through the pushing operation of the air cylinder 45.

All of the weft inserting main nozzle 26 and the blow nozzles 37, 42 are connected to the pressurized air supply tank through two-way type electromagnetic valves $V_8$, $V_9$ and $V_{10}$, while the air cylinder 45 is connected to the pressurized air supply tank through a three-way type electromagnetic valve $V_{11}$.

Figure 10:
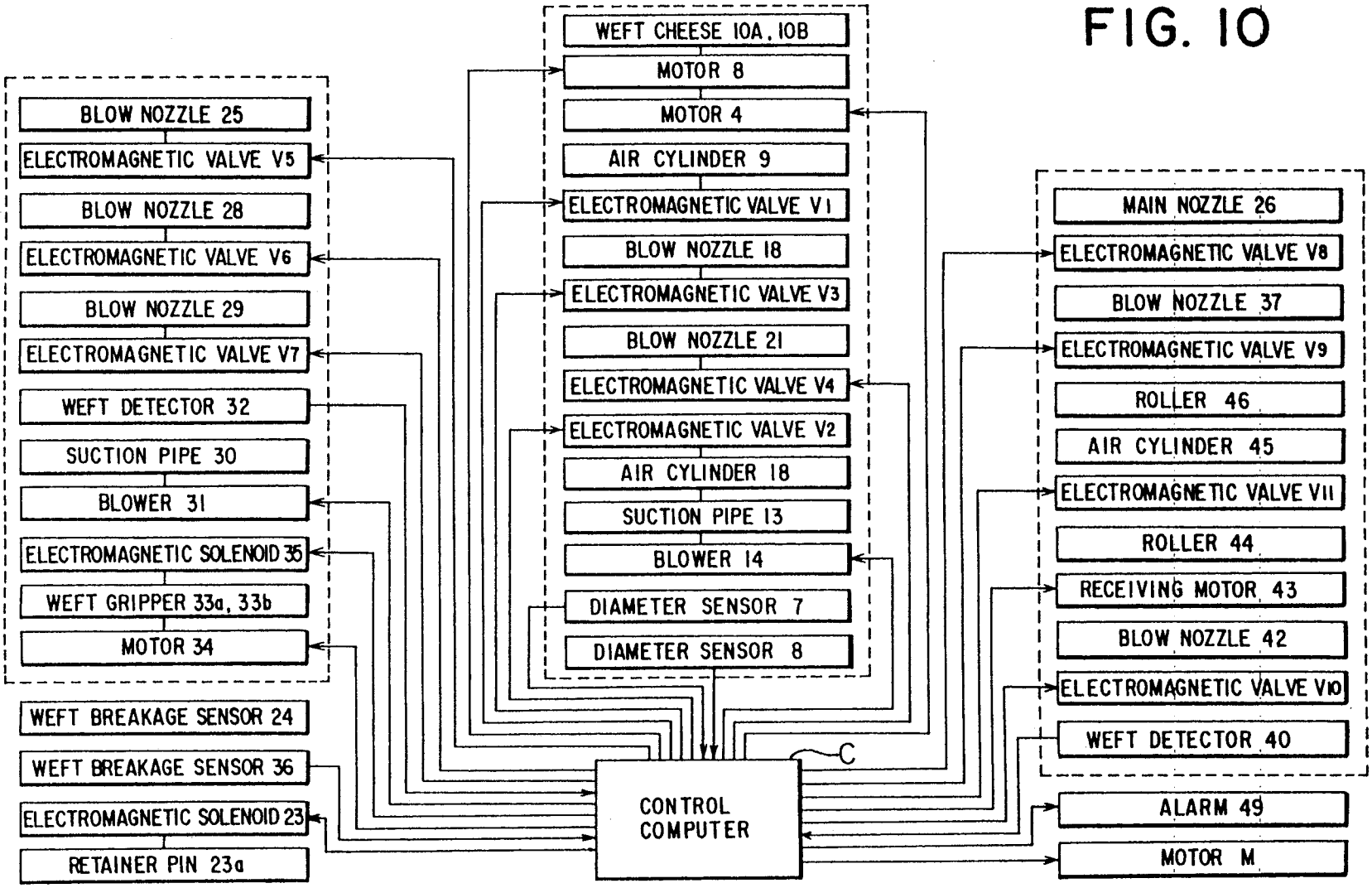
FIG. 10 is a block diagram for explaining operation of the loom shown in FIG. 1.
Figure 11A:
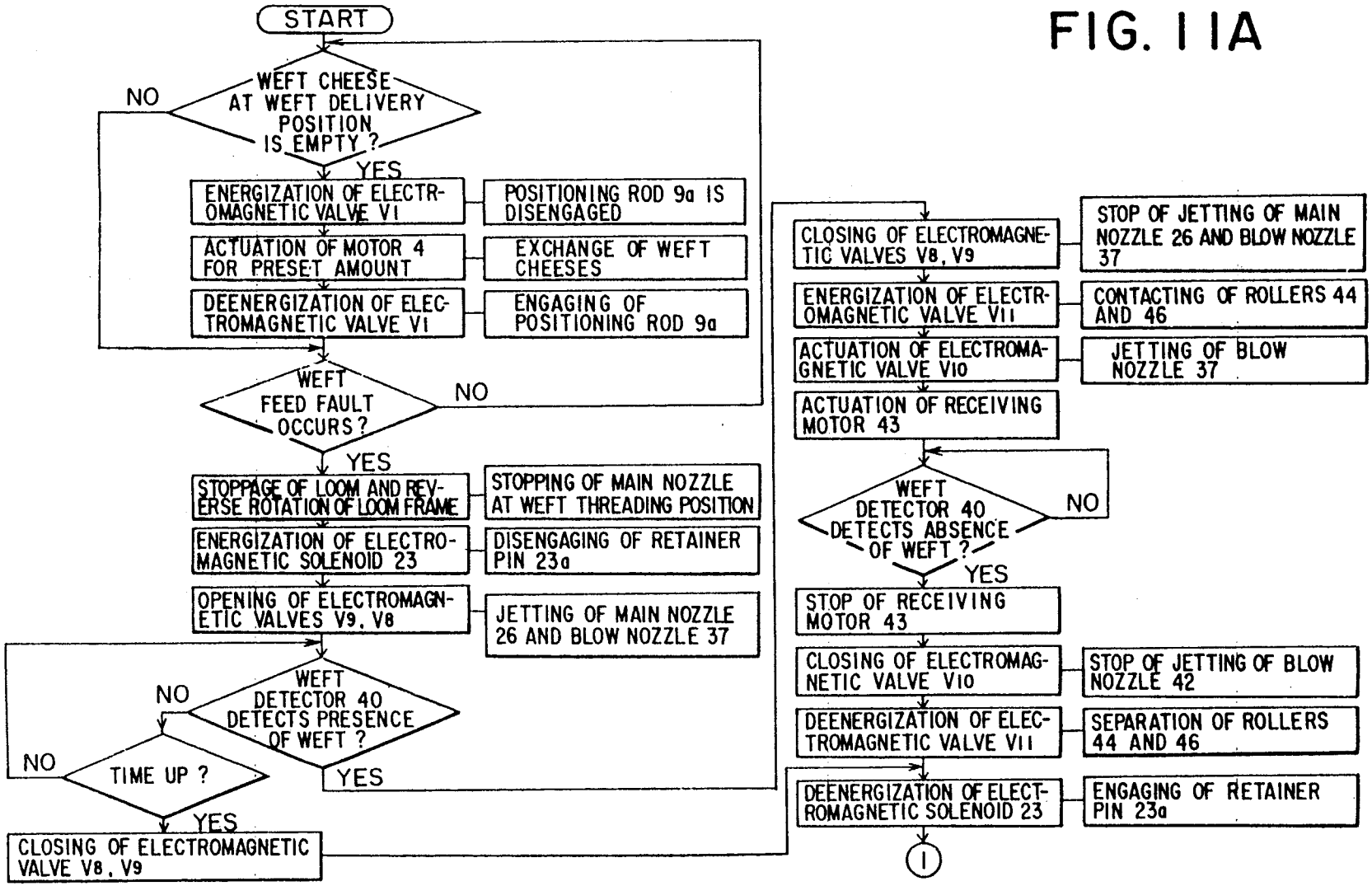
FIGS. 11A to 11D are flow charts for illustrating a weft processing program for the loom shown in FIG. 1.
Figure 11B:
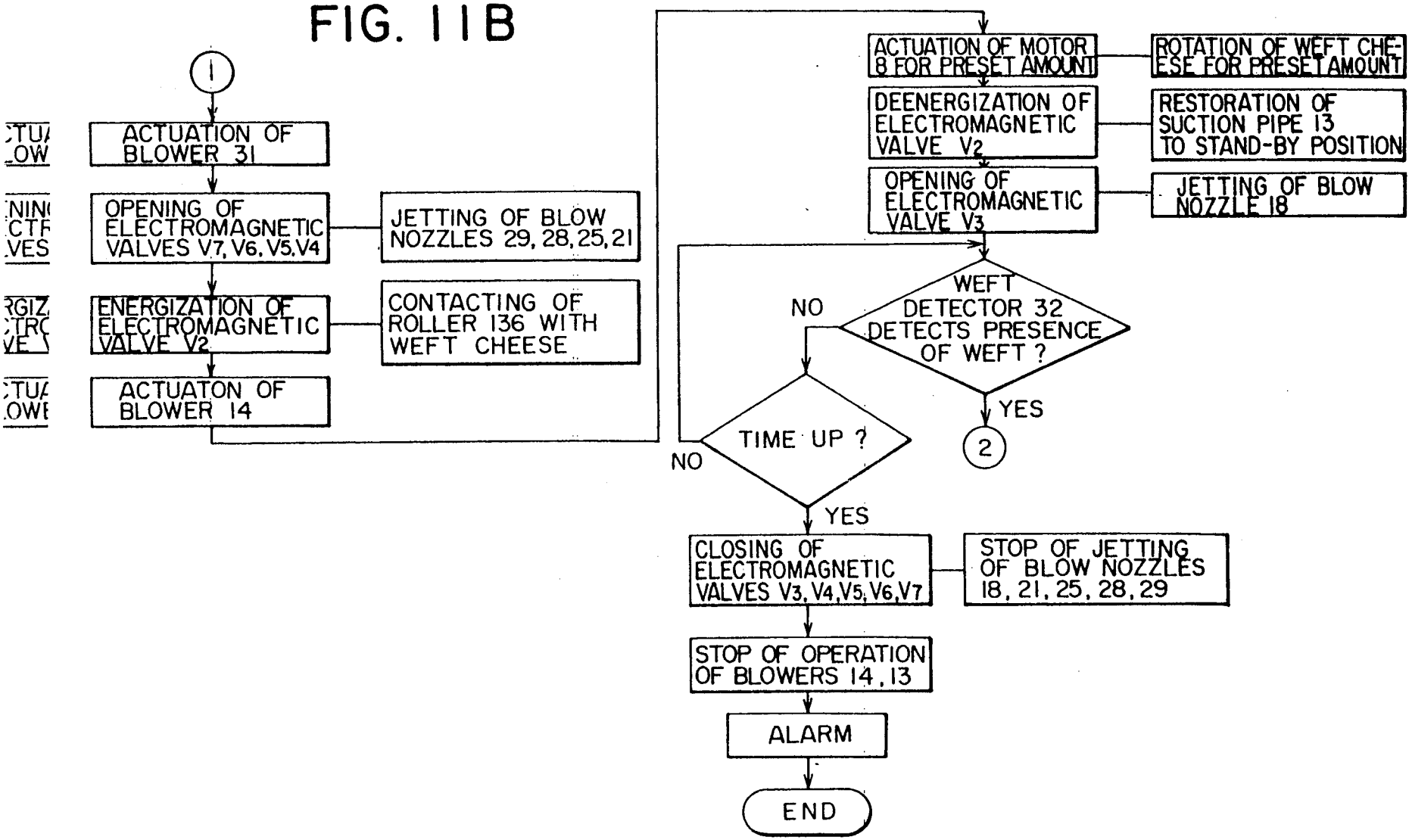
Figure 11C:
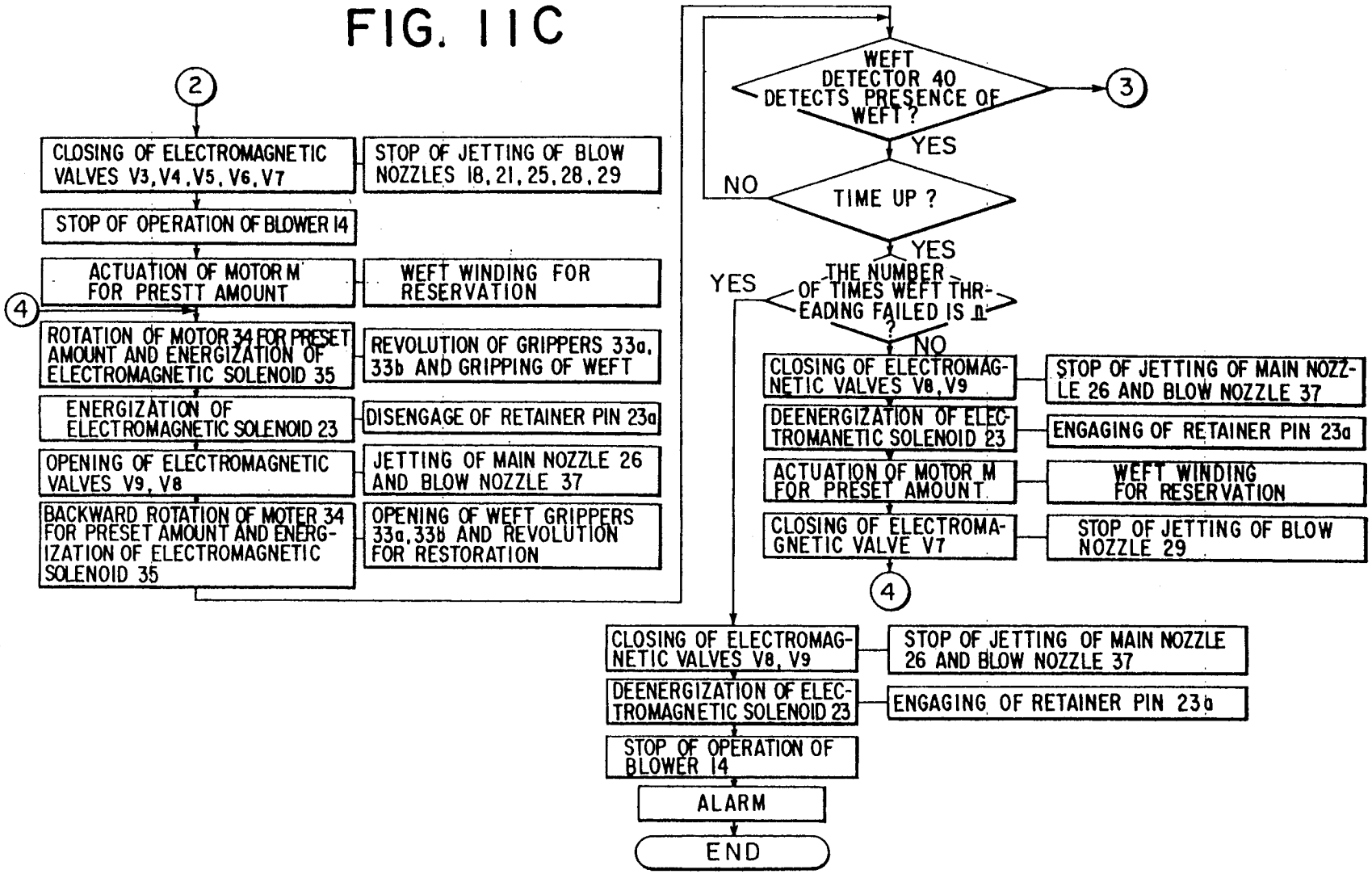
Figure 11D:
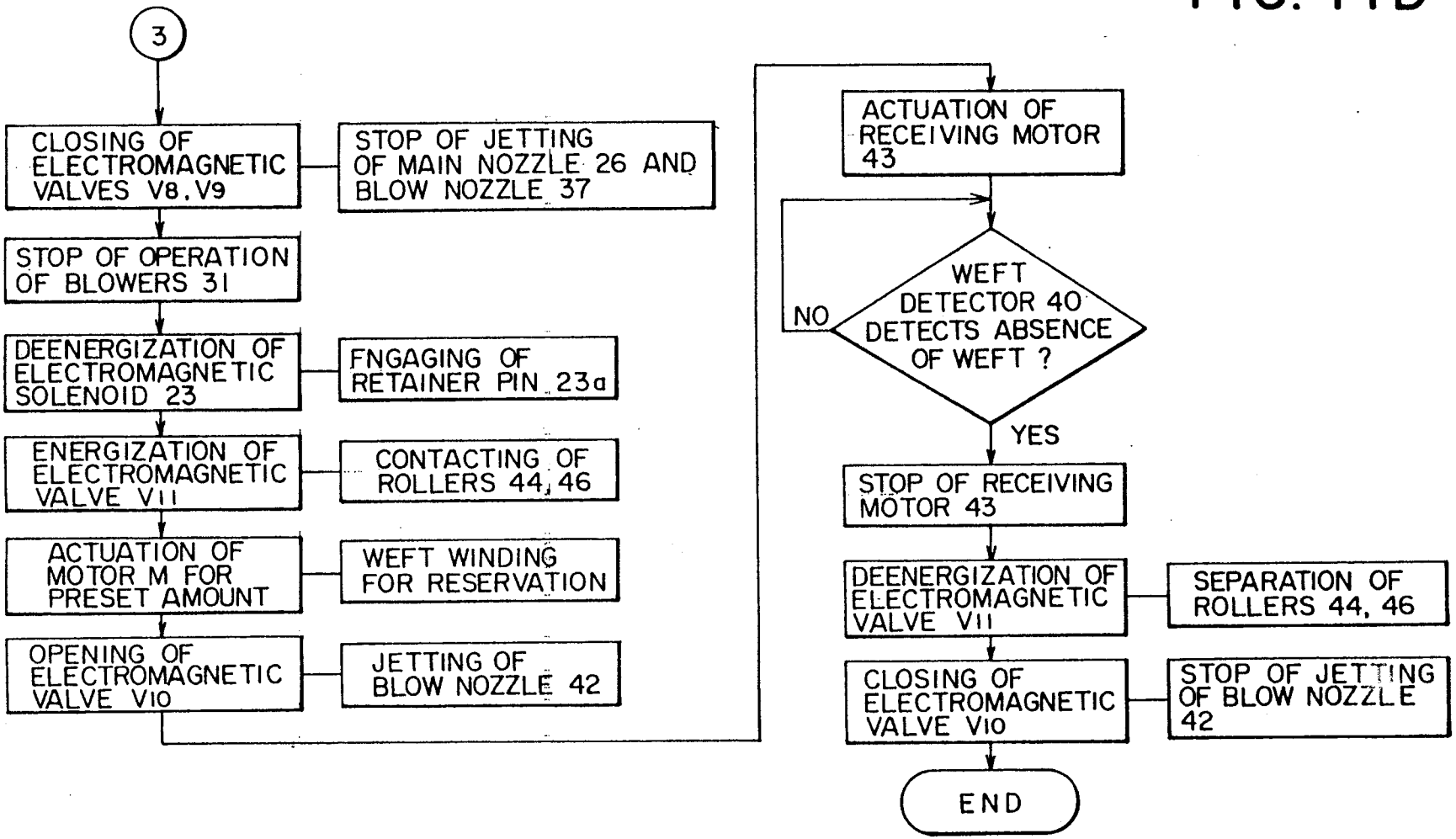

As seen in FIG. 10, the individual electromagnetic valves $V_1$ to $V_{11}$, the motors 4, 8, 34, 43 and M, the blowers 14 and 31 and the electromagnetic solenoids 23 and 35 are controlled under the command of a control computer C which is provided separately from a loom control computer. The control computer C performs on/off (open/close) control of the electromagnetic valves $V_1$ to $V_{11}$ in response to the detection signals generated by the weft breakage sensors 24 and 36, the weft detectors 32 and 40 and the winding diameter sensors 47 and 48 and additionally controls electrical energization and deenergization of the motors 4, 8, 34, 43 and M, the blowers 14 and 31 and the electromagnetic solenoids 23 and 35.

FIG. 11A to 11D show flow charts for explaining a weft processing program activated when weft breakage takes place between the weft cheese 10A or 10B and the weft length-measuring and reserving apparatus 22, i.e. when the weft breakage sensor 24 detects the absence of the weft during operation of the loom. The weft processing procedure will be described below by reference to the above-mentioned flow charts.

Now, it is assumed that the loom is running and the weft feeding is effectuated from the weft cheese located on the side to the transporting guide 17 (the weft cheese 10A in the case of the illustrated embodiment). The state in which the weft is drawn out from the weft cheese 10A during operation of the loom is shown in FIGS. 1 and 2. When the weft cheese 10A becomes empty, this empty state is detected by the winding diameter sensor 47. On the basis of the detection signal from the winding diameter sensor 47, the control computer C commands the opening of the electromagnetic valve $V_1$, whereby the positioning rod 9*a* is retracted from the positioning recess 3*a*. Subsequently, the control computer C issues a command to allow the electric motor 4 to rotate over a predetermined angular distance for rotating the turn table 3 by a half-rotation. In this manner, the weft cheeses 10A and 10B are exchanged with each other, resulting in that the weft cheese 10B being set at a position for allowing the draw-out or delivery of the weft therefrom.

Assuming that the weft $Y_1$ is broken on the weft feeding path between the weft cheese 10A in the weft delivery position and the weft length-measuring and reserving apparatus 22, the weft breakage is detected by the weft breakage sensor 24, as a result of which a weft feed fault signal is supplied to the control computer C. In response to this weft feed fault signal, the control computer C sends a loom operation stop signal to the loom control computer which responds thereto by issuing a loom operation stop command. As a result, the weft inserting main nozzle 26 on the slay is caused to stop at a position in the vicinity of the cloth fell of the fabric being woven. After the loom has been stopped, the loom control computer issues a command for causing the loom frame to rotate reversely for a predetermined angular distance to move the weft inserting main nozzle 26 to the most retracted position (weft threading position) shown in FIG. 8.

In succession to the reverse rotation of the loom frame mentioned above, the control computer C issues a command for energization of the electromagnetic solenoid 23 and the opening of the electromagnetic valves $V_9$ and $V_8$, whereby the retainer pin 23*a* is moved away from the weft winding surface 22*b* while the blower nozzle 37 and the weft inserting main nozzle 26 jet air streams, respectively. When the weft remains wound on the weft winding drum surface 22*b*, the remaining weft is then ejected from the weft inserting main nozzle 26. However, due to the intensive blow-up action of the blow nozzle 37, the remaining weft is introduced into the weft introducing duct 38 to an extent to reach the position where the weft detector 40 is installed within the air guide 39.

The control computer C responds to the weft presence detection signal from the weft detector 40 to issue a command for closing the electromagnetic valves $V_8$ and $V_9$ while commanding the opening of the electromagnetic valve $V_{11}$. Thus, the weft inserting main nozzle 26 and the blow nozzle 37 stop the air jetting operation, while the rollers 44 and 46 are pressed against each other. In this manner, the weft introduced into the air guide 39 is gripped under pressure between the rollers 44 and 46.

The control computer C commands the opening of the electromagnetic value $V_{10}$ and the actuation of the electric motor 43, as a result of which the blow nozzle 42 jets air flow and at the same time the weft transfer operation by the rollers 44 and 46 is started. When the weft has passed through the paired rollers 44 and 46 therebetween, the weft detector 40 detects the absence of the weft. In response to the weft absence detection signal of the detector 40, the control computer C commands the stoppage of the transfer motor 43. Additionally, the control computer C commands the closing of the electromagnetic valves $V_{10}$ and $V_{11}$ as well as deenergization of the electromagnetic solenoid 23. Thus, the air jet discharge from the blow nozzle 42 is stopped. Further, the rollers 44 and 46 are caused to move away from each other. The retainer pin 23*a* engages the weft winding drum surface 22*b*.

In case no weft remains wound on the weft winding surface 22*b*, the weft detector 40 can never detect the presence of the weft. Unless the weft presence signal is obtained within a predetermined time period, the control computer C performs a weft feed operation, which will be described below in detail.

Figure 4:
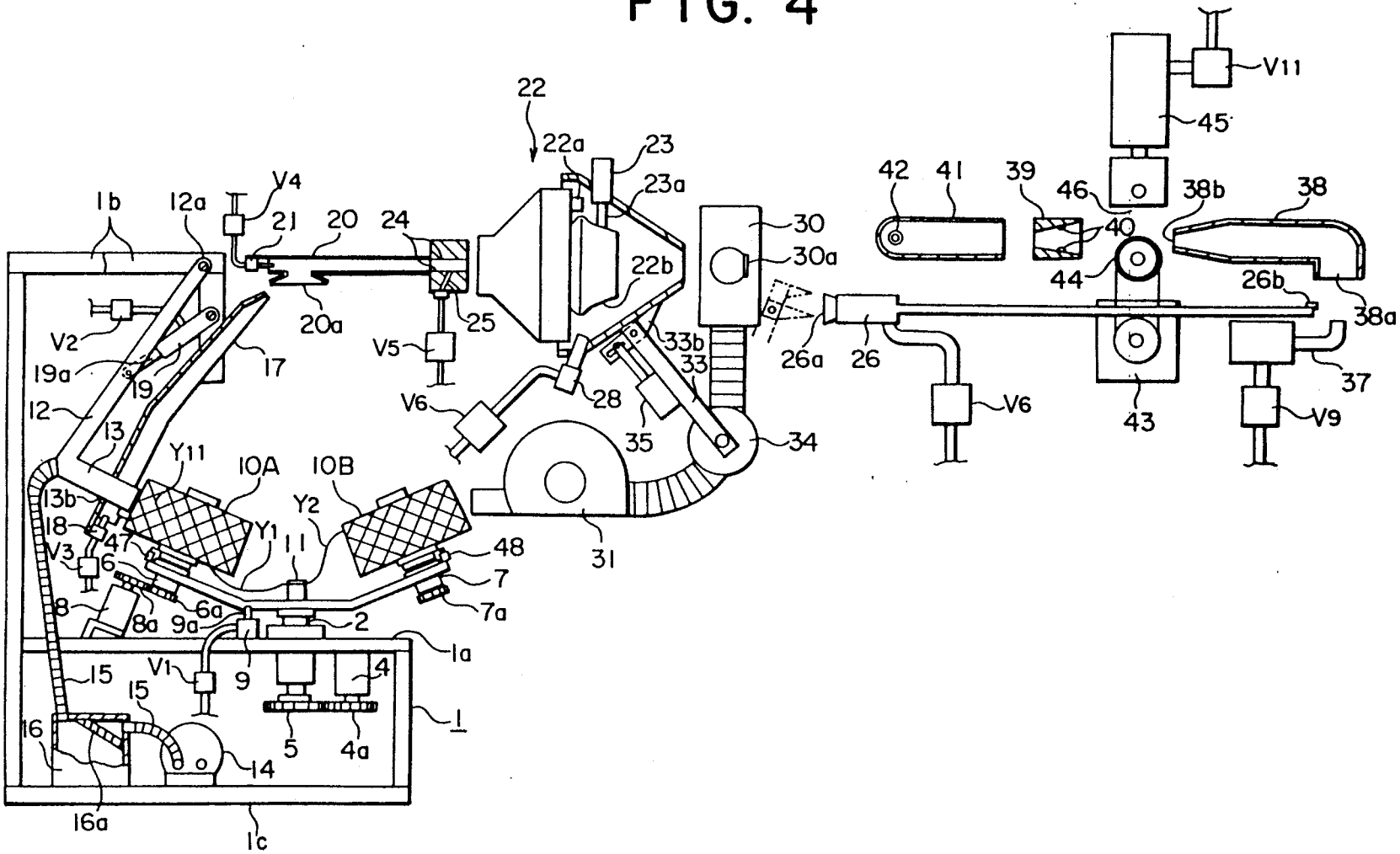
FIG. 4 is a side elevational view for explaining the state in which a suction arm is swung under gravity in the loom shown in FIG. 1.
Figure 5:
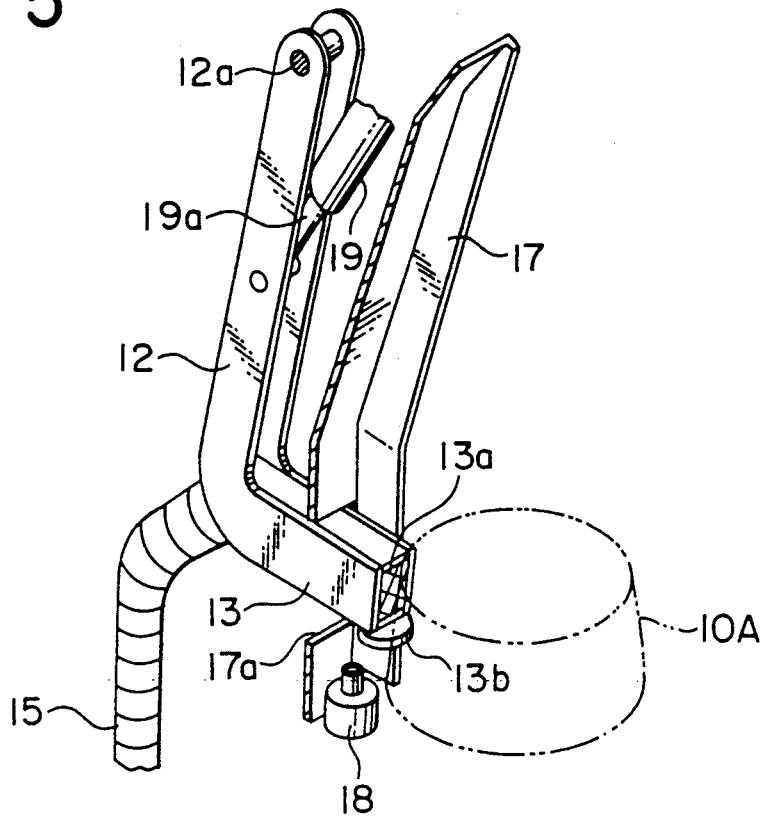
FIG. 5 is a perspective view showing a major portion of the weft processing apparatus according to an embodiment of the invention in the state illustrated in FIG. 4.
Figure 6:
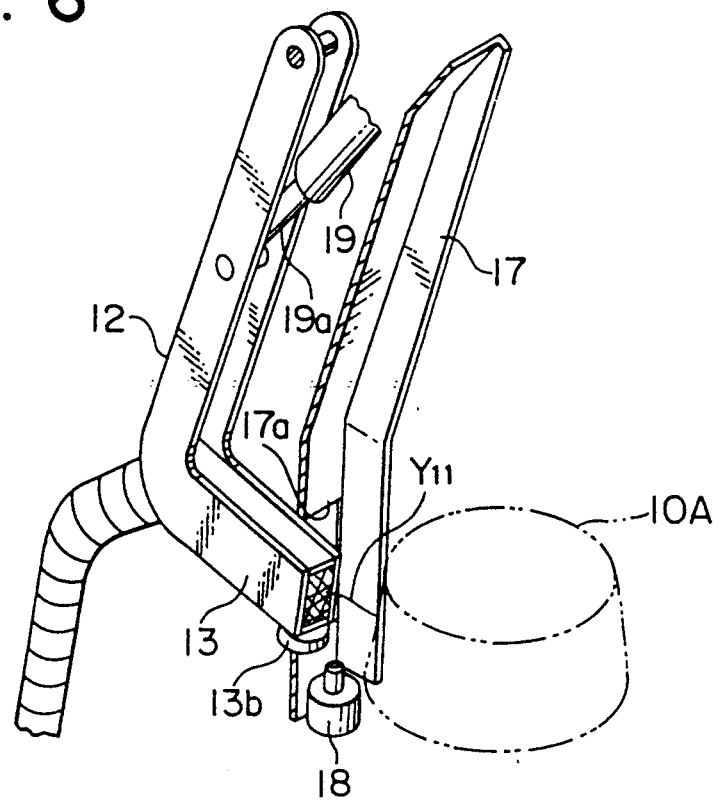
FIG. 6 is a perspective view showing a major portion of the weft processing apparatus for explaining the state in which the suction arm holding the weft in the congregated state has been restored to a stand-by position in the loom shown in FIG. 1.

The control computer C commands actuation of the blower 31 and at the same time opening of the electromagnetic valves $V_7$, $V_6$, $V_5$ and $V_4$. Consequently, between the blow nozzle 29 and the suction pipe 30, there is developed an air flow or stream directed toward the suction pipe 30, while the blow nozzles 29, 28 and 25 jet the air streams, respectively, causing the air to flow through the weft winding tube 22*a* in the direction from the tip or outlet end of the weft winding tube 22*a* toward the converging guide duct 27. The air flow blown out from the weft winding tube 22*a* is caused to be discharged in a convergent condition from the outlet of the convergent guide tube 27 under the converging action of the latter into a region between the blow nozzle 29 and the suction pipe 30 and merged to the air flow or stream developed between the blow nozzle 29 and the suction pipe 30 to be thereby introduced into the suction pipe 30. After the air flow has taken placed along the path extending from the weft inserting guide 20 to the suction pipe 30, the control computer C commands energization of the electromagnetic valve $V_2$ to thereby trigger the retracting operation of the air cylinder 19. As a consequence, the suction arm 19 rotates downwardly about the supporting shaft 12*a* under gravity, as illustrated in FIGS. 4 and 5, which in turn results in that the roller 13*b* mounted on the suction pipe 13 is caused to bear against the peripheral surface of the weft cheese 10A. In this state, the net 13*a* in the suction pipe 13 is positioned closely to the peripheral surface of the weft cheese 10A. Subsequently, the control computer C commands actuation of the blower 14, whereby suction takes place at the tip end of the suction pipe 13. Thereafter, the control computer C commands a predetermined amount of rotation for the motor 8, resulting in that the weft cheese 10A is caused to rotate for a predetermined angular distance. Due to the sucking action of the suction pipe 13 and the rotation of the peripheral surface of the weft cheese 10A, the leading end $Y_{11}$ of the weft on the weft cheese 10A is sucked by the suction pipe 13 through interposition of the net 13*a*, whereby the weft leading end $Y_{11}$ is held on the net 13*a* under suction. In this manner, the weft leading end $Y_{11}$ is held on the net 13*a* densely or in a congregated condition by suitably setting the amount of rotation of the weft cheese 10A.

Figure 7:
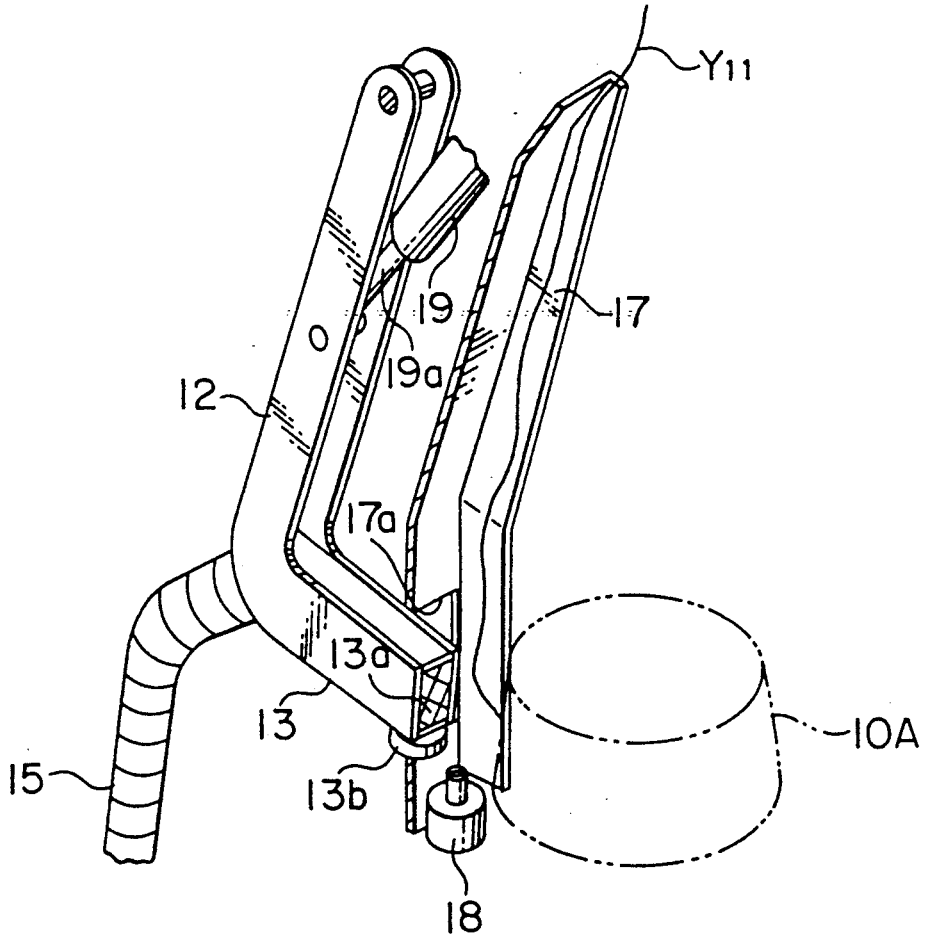
FIG. 7 is a perspective view showing a major portion of the weft processing apparatus according to the invention in the state where the weft end, which has been held in the congregated state, is being transported along a transporting guide.
Figure 8:
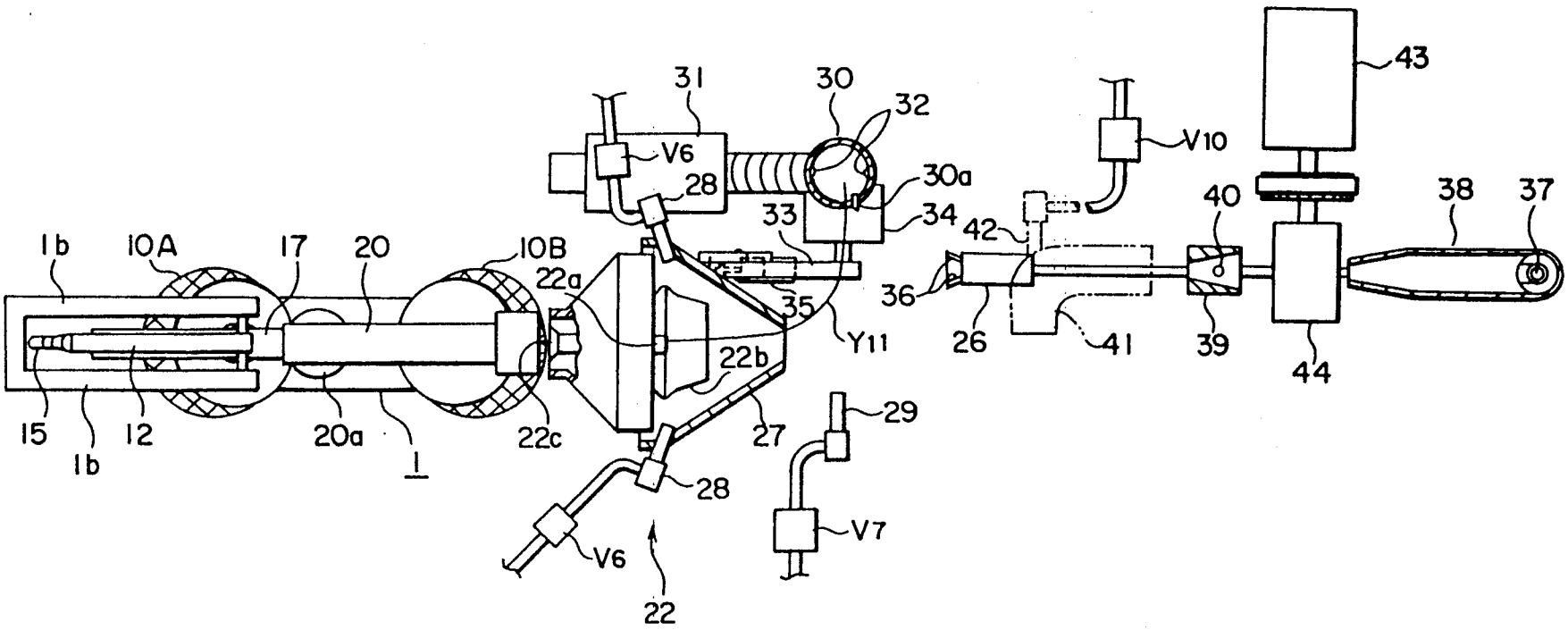
FIG. 8 is a plan view showing in section the loom of FIG. 1 in the state where the leading end of a weft has been threaded through a weft length-measuring and reserving apparatus.
Figure 9:
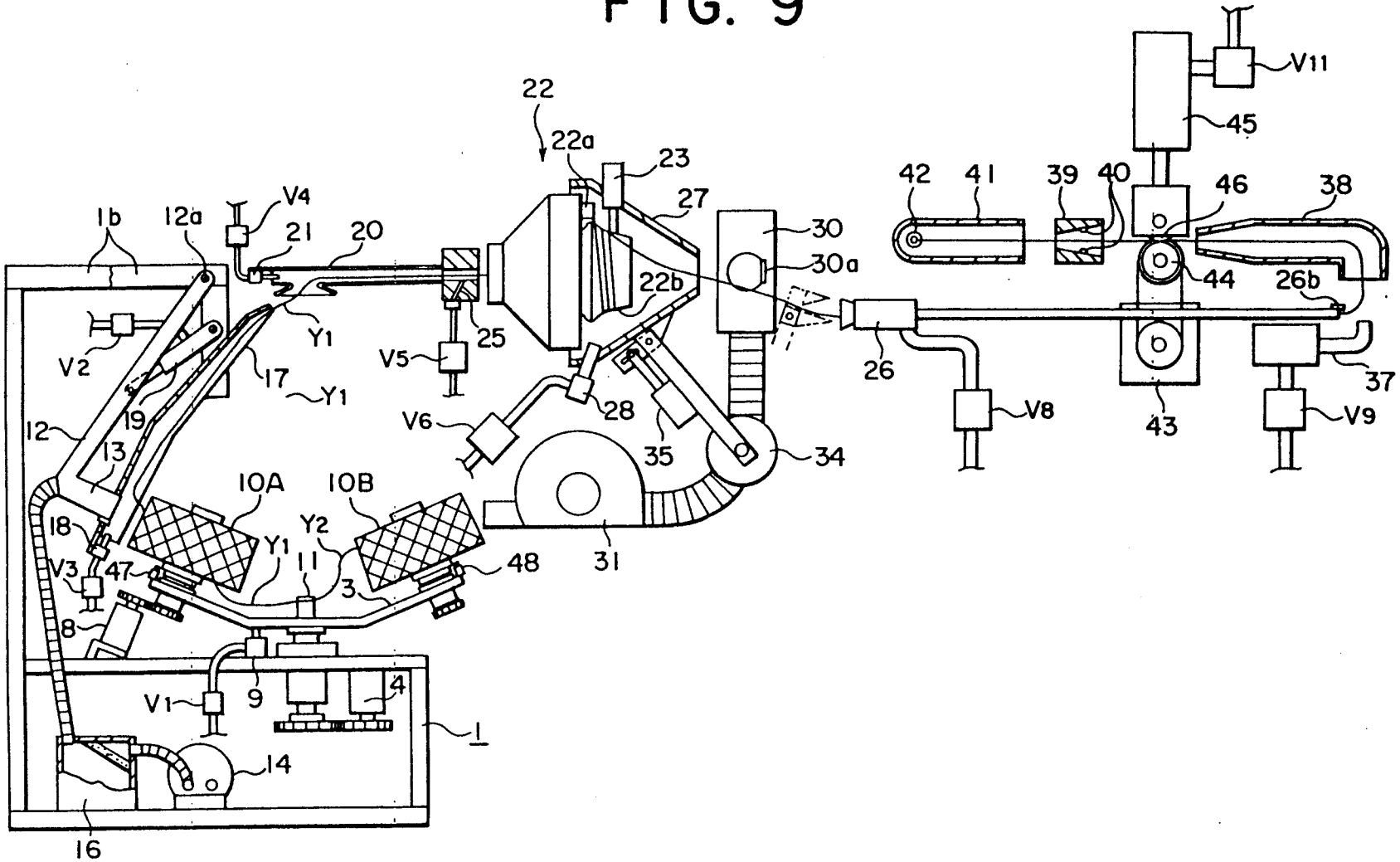
FIG. 9 is a side elevational view showing, partly in section, the loom of FIG. 1 in the state where the leading end of a weft has been threaded to a contacting area between a pair of receiving rollers brought into contact with each other.

After rotation of the weft cheese 10A for a predetermined angular distance, the control computer C issues a command for deenergization of the electromagnetic valve $V_2$, whereby the suction pipe 13 is restored to the stand-by position. As a result of the restoration of the suction pipe 13, the leading end $Y_{11}$ of the weft held on the net 13*a* in the congregated state under suction is disposed in the vicinity of the innermost surface of the transporting guide 17. Starting from this state, the control computer C issues a command for opening the electromagnetic valve $V_3$, which is followed by jetting of air from the blow nozzle 18. The jetted air flow from the blow nozzle 18 sweeps over the innermost surface of the transporting guide 17, whereby the leading end $Y_{11}$ of the weft held on the net 13*a* in the congregated state is carried or transferred to the weft inserting guide 20 along the transporting guide 17, as illustrated in FIG. 7.

The leading end $Y_{11}$ of the weft held on the net 13*a* in the congregated state effectively undergoes the jet action of the blow nozzle 18 because of the congregation thereof. More specifically, the area placed under the pressure brought about by the jet is extremely larger when the weft is in the congregated state as compared with the single weft lying linearly. Thus, by slightly increasing the jetting action of the blow nozzle 18 over the suction effect of the suction pipe 13, the transportation of the leading end of the weft in a satisfactory manner can be realized. In this manner, the leading end $Y_{11}$ of the weft led out from the periphery of the weft cheese 10A can be positively transported to the weft length-measuring and reserving apparatus 22. In other words, this ensures the transportation of the leading end $Y_{11}$ of the weft to the weft length-measuring and reserving apparatus 22 from the weft cheese 10A which is prerequisite for the successful threading to the weft length-measuring and reserving apparatus 22.

In this conjunction,. it is noted that in the case of the suction and gripping structure adopted heretofore for introducing the leading end of the weft under suction into the suction pipe, it was necessary to trim neatly the leading end of the introduced weft by a cutter. Unless this trimming is performed, the leading end of the weft placed in the suction pipe would present resistance to the transportation of the weft leading end to another place by the air flow, making it more difficult to transport the weft leading end gripped in a linear form. In contrast, in the case of the illustrated embodiment of the present invention, there exists no necessity for performing the trimming by a cutter as mentioned above, which in turn means that the relevant structure as well as the control involved can be much simplified to great advantage.

The suction pipe 13 provided with the net 13*a* which ensures the positive weft transportation is ordinarily disposed and held at the stand-by position by means of the air cylinder 19 in the extended state. Accordingly, operation for causing the net 13*a* mounted at the tip end of the suction pipe 13 to approach to the periphery of the weft cheese 10A can be validated simply by retracting the air cylinder 19, i.e. simply by energizing the associated electromagnetic valve $V_2$. More specifically, when the electromagnetic valve $V_2$ is energized, the suction arm 12 swings downwardly under gravity until the roller 13*b* bears on the peripheral surface of the weft cheese 10A. This operation can take place independent of the diameter of the weft cheese 10A. Thus, the control for positioning the net 13*a* mounted at the tip end of the suction pipe 13 closely to the periphery of the weft cheese 10A can be simplified extremely regardless of the diameter of the weft cheese 10A.

In the structure which allows the tip or free end of the suction pipe 13 to be automatically positioned under gravity in the vicinity of the periphery of the weft cheese 10A, the disposition of the weft cheese 10A at the weft drawout position provides an important factor. Thus, when the weft cheese 10A at the weft delivery position has been exhausted and the other weft cheese 10B must be moved to the weft delivery position, as in the case of the illustrated embodiment of the invention, it is necessary to dispose the weft cheese 10B at the weft delivery position with the same orientation and configuration as the weft cheese 10A, i.e. to exchange the weft cheese 10A by the weft cheese 10B. To accomplish such exchange, the turn table 3 is rotatable in a horizontal plane in the case of the illustrated embodiment of the invention. This supporting structure is very advantageous from the standpoint of the balance in weight. In other words, by virtue of the supporting structure described above, the turn table 3 can be rotated very smoothly, which means in effect that the electric motor 4 may be of a small capacity.

In case the weft threading has resulted in failure, e.g. the leading end of the weft $Y_1$ can not pass through the weft length-measuring and reserving apparatus 22, the weft $Y_1$ reaches short of the suction pipe 30. In that case, the weft presence detection signal is not obtained from the weft detector 32 within a predetermined time period. Accordingly, the control computer C commands the closing of the electromagnetic valves $V_3$, $V_4$, $V_5$, $V_6$ and $V_7$ as well as inhibition of operation of the blowers 14 and 31 and at the same time issues an alarm indication to an alarm device 49.

When the weft $Y_1$ can be successfully threaded into the suction pipe 30, the control computer C commands the closing of the electromagnetic valves $V_3$, $V_4$, $V_5$, $V_6$ and $V_7$ as well as stoppage of the blower 14. At this time, the blower 31 still continues to rotate, whereby the leading end of the weft $Y_1$ is held under suction by the suction pipe 30. Starting from this state, the control computer C commands operation of the motor M by a predetermined amount to thereby cause the weft winding tube **22*a* to be rotated by a predetermined amount. In this way, there is preparatorily wound a predetermined amount or length of the weft $Y_1$ on the weft winding surface 22*b***.

Subsequently, the control computer C commands a predetermined amount of rotation of the electric motor 34 and the energization of the electromagnetic solenoid 35. As a result, the weft grippers **33*a* and 33*b* now in the opened state are caused to pass through the tensioned region of the weft $Y_1$ while rotating, after which the weft grippers 33*a* and 33*b* are closed, whereby the weft $Y_1$ is gripped by the weft grippers 33*a* and 33*b*. The weft $Y_1$ as gripped is brought into contact with the stationary cutter blade 30*a* mounted on the suction pipe 30 to be cut and separated upon moving of the gripped weft $Y_1$ toward the entrance 26*a* of the weft inserting main nozzle 26. In this manner, the weft $y_1$ extending from the weft grippers 33*a* and 33*b* is sized at a predetermined constant length, whereby the leading end of the sized weft $Y_1$ extending from the weft gripper 33*a* and 33*b* is disposed in the vicinity of the entrance 26*a* of the weft inserting main nozzle 26**.

Upon stoppage of the motor 34 after forward rotation thereof by a predetermined amount, the control computer C commands the energization of the electromagnetic solenoid 23 and at the same time the opening of the electromagnetic valves $V_9$ and $V_8$, whereby the retainer pin **23*a* is disengaged from the weft winding surface 22*b* while the blow nozzle 37 and the weft inserting main nozzle 26 produce air jets, respectively. This results in that an intake air flow occurs in the entrance 26*a* of the weft inserting nozzle 26, whereby the leading end of the weft $Y_1$ extending from the weft grippers 33*a* and 33*b* is introduced into the weft inserting main nozzle 26**.

Subsequently, the control computer C commands the deenergization of the electromagnetic solenoid 35 and the reverse or backward rotation of the motor 34 for the predetermined amount. Thus, after releasing the leading end of the weft $Y_1$, the weft grippers **33*a* and 33*b* are restored to the stand-by position. On the other hands, the leading end of the weft $Y_1$ placed in the weft inserting main nozzle 26 is blown out therefrom to be introduced into the weft introducing duct 38 under the jet action of the blow nozzle 37**.

When the leading end of the weft $Y_1$ has attained the position of the weft detector 40 installed within the air guide 39, the control computer C performs in succession subsequent wefts processing on the basis of the weft presence detection information from the weft detector. When the threading of the weft through the weft inserting main nozzle 26 has failed, the leading end of the weft $Y_1$ can not reach the position of the weft detector 40. Thus, the control computer C monitors whether or not the weft presence detection information is obtained from the weft detector 40 within the preset time duration and unless the information is obtained, the control computer C commands the closing of the electromagnetic valves $V_8$ and $V_9$ as well as the deenergization of the electromagnetic solenoid 23, as a result of which the jetting operation of the weft inserting main nozzle 26 and the blow nozzle 37 is interrupted and at the same time the retainer pin **23*a* is caused to engage with the weft winding surface 22*b***.

So long as the number of times the weft threading ended in failure has not attained a preset number n, processing operation succeeding to the winding of the weft for reservation on the weft length-measuring and reserving apparatus 22 is performed by the control computer C and, if otherwise, the latter issues a command for stopping operation of the blower 31 and activating the alarm apparatus 49.

When the weft threading has ended successfully, the control computer C responds to the weft presence detection signal outputted from the weft detector 40 to issue commands for closing the electromagnetic valves $V_8$ and $V_9$, stoppage of operation of the blower 31 and deenergization of the electromagnetic solenoid 23, respectively. In succession, the control computer C commands the energization of the electromagnetic valve $V_{11}$ to thereby cause the air cylinder 45 to extend, whereby the driven roller 46 is brought into contact with the driving roller 44, resulting in that the weft $Y_1$ is held between both the rollers 44 and 46. Subsequently, the control computer C commands rotation of the motor M by a predetermined amount to cause the weft $Y_1$ to be wound for reservation by a predetermined amount. After the weft winding for reservation, the control computer C commands the opening of the electromagnetic valve $V_{10}$ and at the same time operation of the weft transfer motor 43. Thus, the weft $Y_1$ is transferred and cut in the state under tension by the stationary cutter blade **26*b*. The fragment of the weft resulting from the cutting is transferred to the rollers 44 and 46 to be discharged into the dust box by the blow nozzle 42**.

When the entire length of the weft $Y_1$ resulting from the cutting has passed through the air guide 39, the weft detector 40 detects the absence of the weft. In response to the weft absence detection information, the control computer C commands the stoppage of operation of the motor 43 and the deenergization of the electromagnetic valve $V_{11}$. Consequently, the weft transfer motor 43 stops operation to allow the paired rollers 44 and 46 to move away from each other. Subsequently, the control computer C commands the closing of the electromagnetic valve $V_{10}$, whereby the air jetting operation of the blow nozzle 42 is terminated. Then, the loom is rotated to the start position, whereupon the loom is restarted.

The present invention is not limited to the embodiment described above. Therefore an embodiment as shown, for example, in FIG. 12 can be equally conceived without departing from the spirit and scope of the invention.

Figure 12:
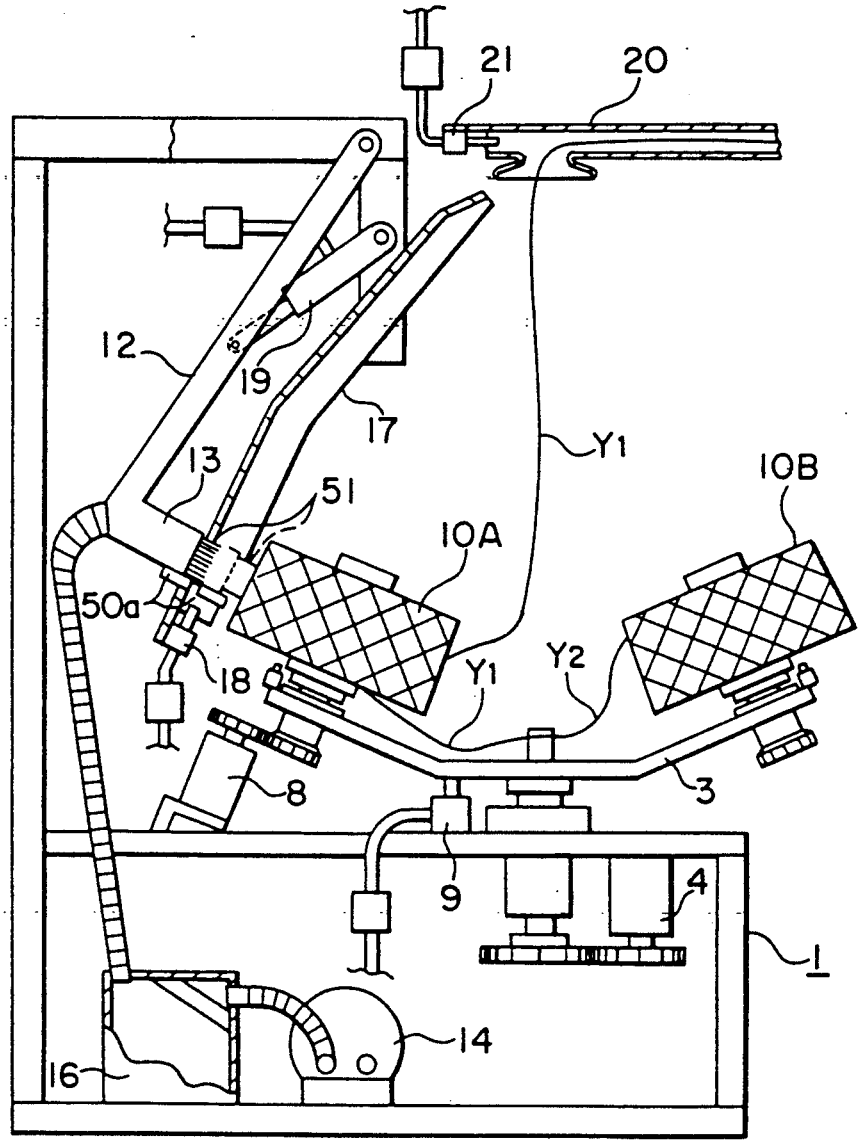
FIG. 12 is a side elevational view showing, partly in section, another embodiment of the weft processing apparatus according to the invention.

Referring to FIG. 12, there is provided an arm 50 rotatably supported so as to swing downwardly under gravity as in the case of the suction arm 12 of the preceding embodiment. The arm 50 is provided at the free or tip end portion thereof with a brush 51. When the arm 50 has been swung under gravity, the roller 50*a* bears on the peripheral surface of the weft cheese 10A so that the free end of the brush 51 is in contact with the peripheral surface of the weft cheese 10A, as indicated by a broken line. Accordingly, as the weft cheese 10A is rotated, the tip end of the brush 51 sweeps the peripheral surface of the weft cheese 10A in the relative sense, as a result of which the leading end portion of the weft $Y_{11}$ drawn or led out from the weft cheese 10A adheres to the tip end of the brush 51 in the congregated state. The holding of the weft $Y_{11}$ by the brush 51 in the congregated state can be realized only by adhesion effective between the tip end of the brush 51 and the weft. Accordingly, the weft $Y_{11}$ adhered to the brush 51 in the congregated state can be easily detached under the jetting action of the blow nozzle 21. By virtue of the structure for holding the weft $Y_{11}$ in the congregated state without relying on the suction effect, the associated mechanism as well as the control thereof can be significantly simplified.

Of course, it goes without saying that the suction effect may be added to the adhesive action of the brush 51. In that case, the draw-out of the leading end of the weft from the periphery of the weft cheese 10A can be ensured with an enhanced reliability.

Figure 13:
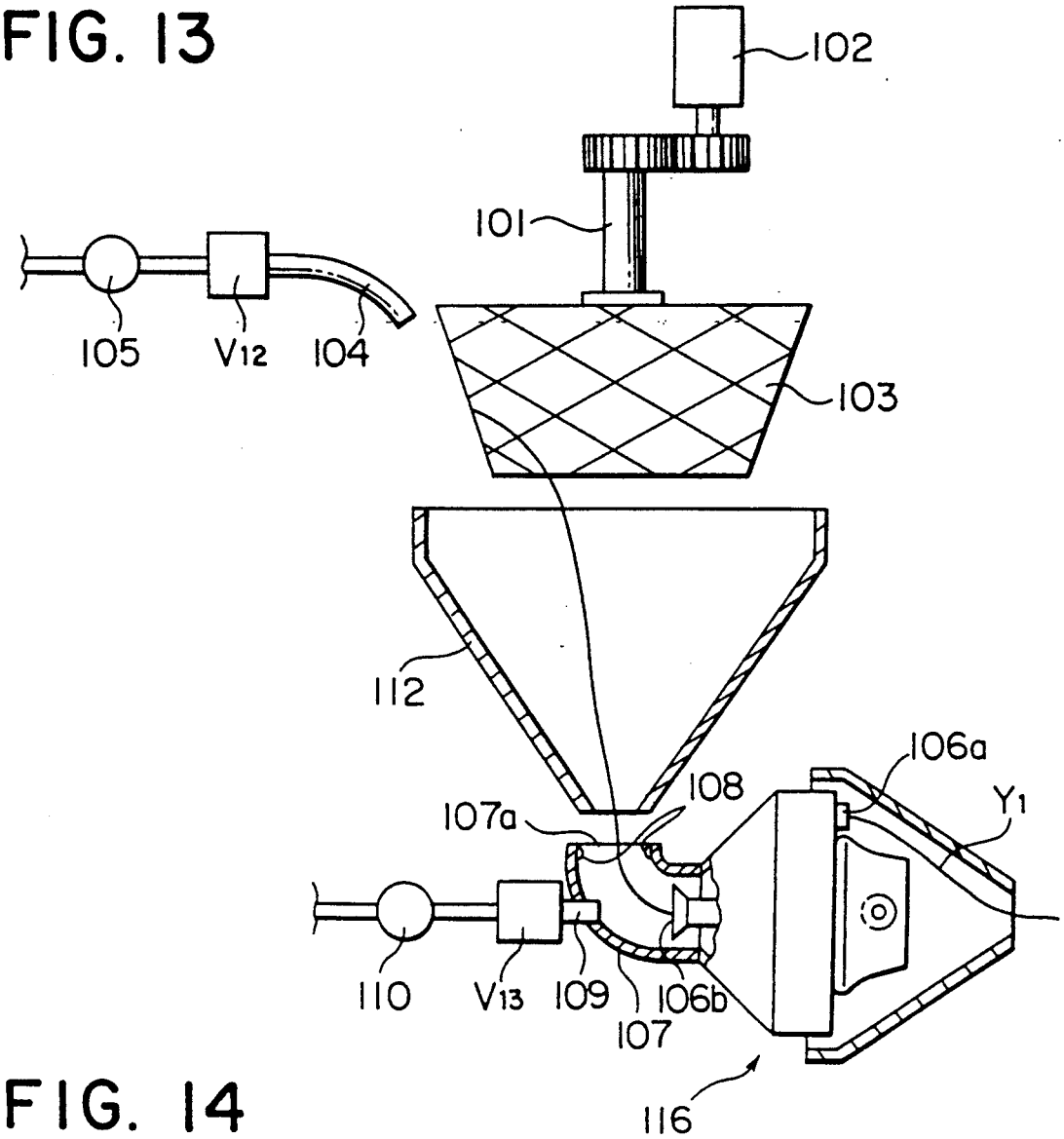
FIG. 13 is an elevational sectional view for explaining the state in which the weft is fed and guided during operation of a loom equipped with the weft processing apparatus according to another embodiment of the invention.
Figure 14:
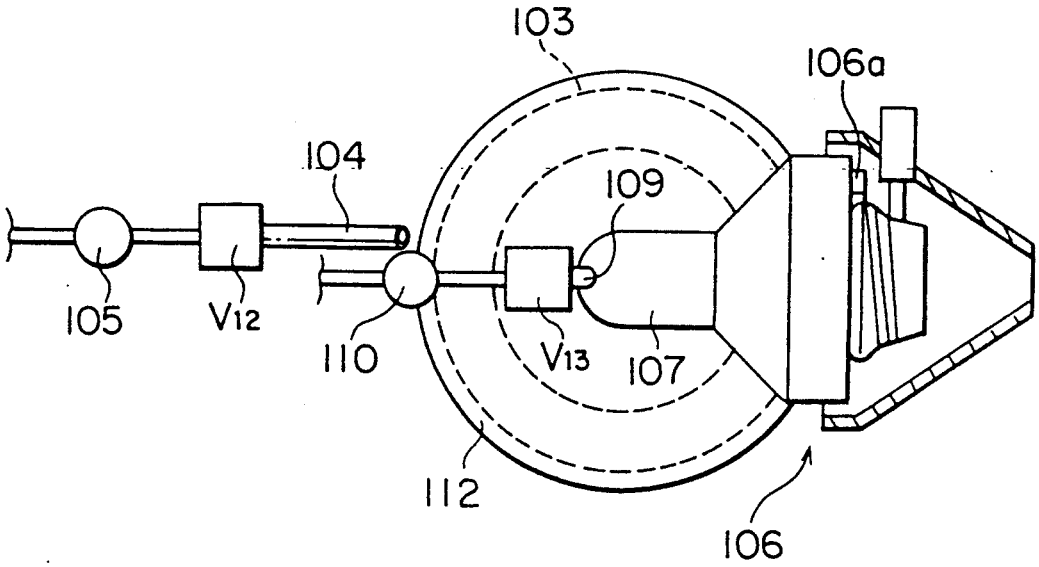
FIG. 14 is a fragmentary plan view showing partly in section the loom of FIG. 13.

A further embodiment of the present invention is illustrated in FIGS. 13 and 14, in which a weft releasing motor 102 is operatively coupled to the base end portion of a rotatably supported holding bracket 101 through a gear train so that a weft cheese 103 mounted on the holding bracket 101 can be rotated in the weft releasing direction by the operation of the weft releasing motor 102.

Referring to FIGS. 13 and 14, a weft releasing blow nozzle 104 is disposed in the vicinity of the peripheral surface of the weft cheese 103. An electromagnetic valve $V_{12}$ and a pressure regulating valve 105 are interposed in an air supply path between a blow nozzle 104 and a pressured air supply tank (not shown). The axis along which air is jet from the blow nozzle 104 substantially intersects with that of the weft cheese 103 in the direction toward the base of the peripheral surface of the weft cheese 103 and the axis is set in respect to the direction so as to form a small angle relative to the peripheral surface of the weft cheese 103. With such an arrangement, the air flow or stream jetted from the blow nozzle 104 sweeps the peripheral surface of the weft cheese 103 in the direction from the base end thereof toward the tip end.

Installed downstream of the weft cheese 103 is a weft length-measuring and reserving apparatus 106 having a weft winding tube 106*a* with which a weft introducing port 106*b* enclosed by a weft introducing duct 107 is communicated. A weft detector 108 comprising a transmission type photoelectric sensor is installed at the introducing port 107*a* of the weft introducing duct 107. Further, connected to the weft introducing duct 107 is a weft inserting blow nozzle 109 directed toward the weft introducing port 106*b*. An electromagnetic valve $V_{13}$ and a pressure regulating valve 110 are interposed between the blow nozzle 109 and the pressured air supply tank. The air jet from the weft inserting blow nozzle 109 can reach a weft inserting main nozzle mounted on a slay (not shown) through the weft winding tube 106*a* communicated with the weft introducing port 106*b* of the weft length-measuring and reserving apparatus 106.

Disposed between the weft cheese 103 and the weft length-measuring and reserving apparatus 106 is a weft guide cover 112 of a substantially conical shape having a larger-diameter opening facing toward the weft cheese 103 and a smaller-diameter opening disposed in opposition to the introducing port 107*a* of the weft introducing duct 107. Thus, substantially all of the air flow jetted from the blow nozzle 104 is introduced into the weft guide cover 112 to be guided to the weft introducing duct 107 under the air-flow converging action of the weft guide cover 112.

Upon occurrence of the weft breakage on the way between the weft cheese 103 and the weft length-measuring and reserving apparatus 106, the weft feed failure processing is performed basically in accordance with the program shown in FIG. 10, although some differences in processing steps exist due to structural differences in the individual components between the first embodiment described by reference to FIGS. 1 to 9 and the instant embodiment.

For threading the weft through the weft length-measuring and reserving apparatus 106 and the weft inserting main nozzle (not shown) during the processing for remedying the weft feed failure, it is essential to successfully draw or lead out the weft leading end from the weft cheese 103. The blow nozzle 104 for detaching the weft leading end from the peripheral surface of the weft cheese 103 is directed toward the peripheral base end portion of the weft cheese 103 and extends toward the axis of the weft cheese 103 with a small angle relative to the peripheral surface of the weft cheese 103. With such an arrangement, the air jet from the blow nozzle 104 sweeps the peripheral surface of the weft cheese 103 in the direction from the base end thereof to the tip end. Also, since the weft cheese 103 is rotated by the motor 102 in the direction enabling the weft to be released, the substantially whole peripheral surface of the weft cheese 103 is exposed to the air stream jetted from the blow nozzle 104. Accordingly, by setting the pressure of the air jet from the blow nozzle 104 by appropriately adjusting the pressure regulating valve 105 by taking into account the type of the weft of the weft cheese 103, the weft leading end can be positively detached from the peripheral surface of the weft cheese 103 regardless of the actual diameter thereof.

With the apparatus according to the instant embodiment which can ensure the positive draw-out of the weft leading end without failure independent of the diameter of the weft cheese 103, it is possible to completely consume the weft wound on the weft cheese being used. Of course, the draw-out of the leading end of the weft from a new weft cheese to be used in place of the completely consumed one can be realized in a similar manner, not to say of the processing for remedying the weft feed failure and the weft guide operation accompanying the exchange of the weft cheeses.

Further, since the weft guide cover 112 of a substantially conical shape is so installed in front of the weft cheese 103 that substantially all the air flow jetted from the blow nozzle 104 can be introduced into the duct 107, the running direction of the leading end of the weft detached and drawn out from the weft cheese 103 is oriented toward the inlet port 107*a* of the weft introducing duct 107 under the converging action of the weft guide cover 112. Accordingly, the leading end of the weft is introduced into the duct 107 with an enhanced reliability, whereby the threading of the weft into and through the weft length-measuring and reserving apparatus 106 with the aid of the weft inserting means comprising the weft introducing duct 107 and the weft inserting blow nozzle 109 can be accomplished with great success.

Figure 15:
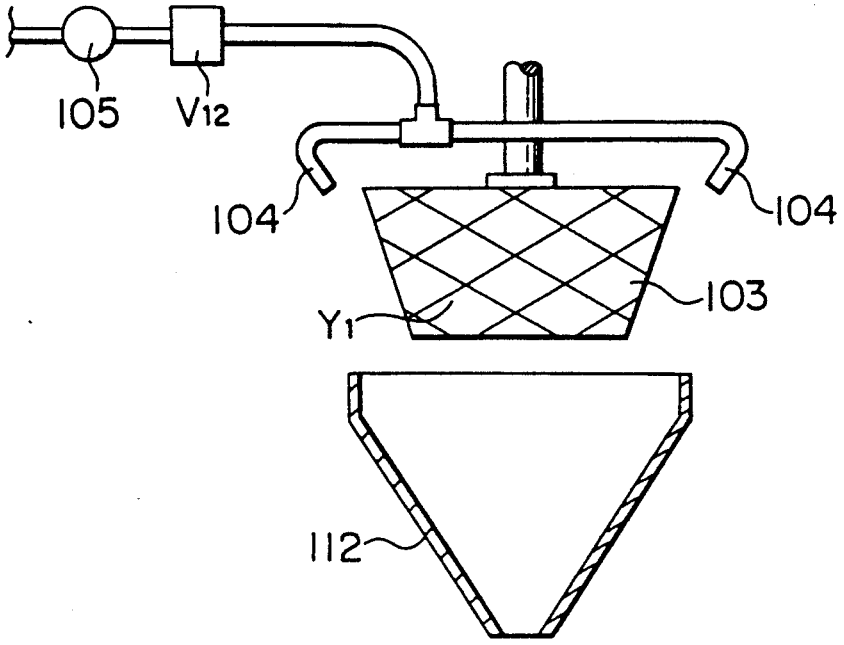
FIGS. 15 to 18 are elevational views showing, partly in section, major portions of further modified embodiments of the weft processing apparatus according to the present invention, respectively.

The embodiment shown in FIGS. 13 and 14 may be modified as described below. Referring to FIG. 15, there is shown a further modification, wherein the weft cheese 103 is fixedly supported and a plurality of equispaced weft releasing blow nozzles 104 (two nozzles in the modification) are circumferentially disposed adjacent the base periphery of the weft cheese 103. The leading end $Y_{11}$ of the weft on the weft cheese 103 is preferably subjected to the sweeping action of the air streams jetted from the blow nozzles 104 disposed with the equidistance therebetween, respectively, whereby the weft leading end can be detached from the peripheral surface of the weft cheese 103 with an increased reliability. Further, the running direction of the weft leading end $Y_{11}$ is forced to be oriented toward the introducing port 107*a* of the weft introducing duct 107, whereby the leading end $Y_{11}$ of the weft is smoothly introduced into the weft introducing duct 107 under the sucking action at the introducing or intake port 107*a*.

Figure 16:
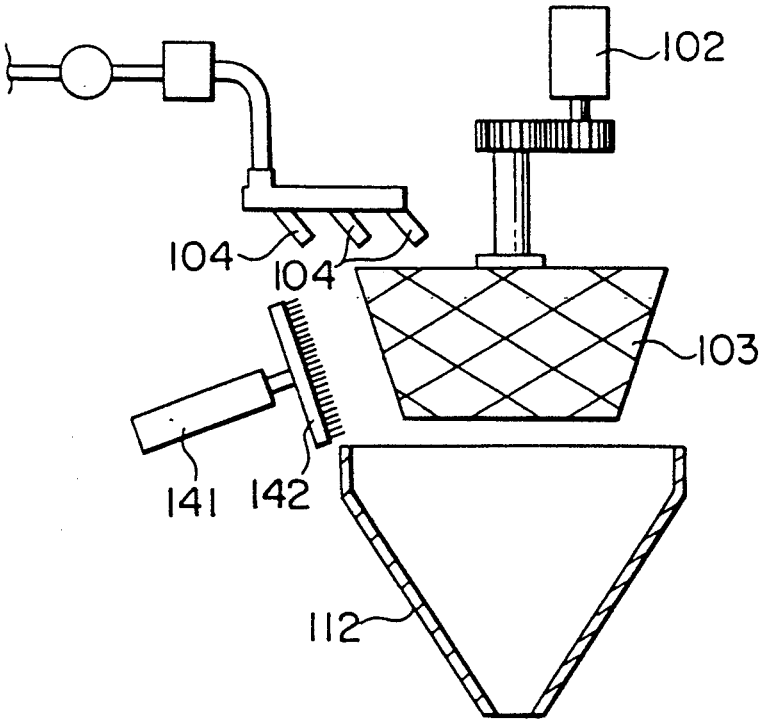

FIG. 16 shows another modification in which a plurality of spaced weft releasing blow nozzles 104 are disposed in an array extending along the radial direction of the weft cheese 103. With this arrangement of the blow nozzles 104, the blow-off action exerted to the leading end $Y_{11}$ of the weft located on the peripheral surface thereof can remain substantially invariable regardless of the different diameters of the weft cheese 103, whereby the action for detaching the weft leading end $Y_{11}$ can be accomplished more effectively and positively. Additionally, a brush 142 may be disposed at a location downstream of the weft releasing blow nozzle 104 with respect to the direction of rotation of the weft cheese 103 in such a manner that the brush 142 can be changed over by a cylinder 141 between a position (not shown) where it contacts the peripheral surface of the weft cheese and a position where it is not in contact with the weft cheese. By additionally providing the brush 142, the leading end $Y_{11}$ of the weft can be released to be drawn out with a higher reliability.

Figure 17:
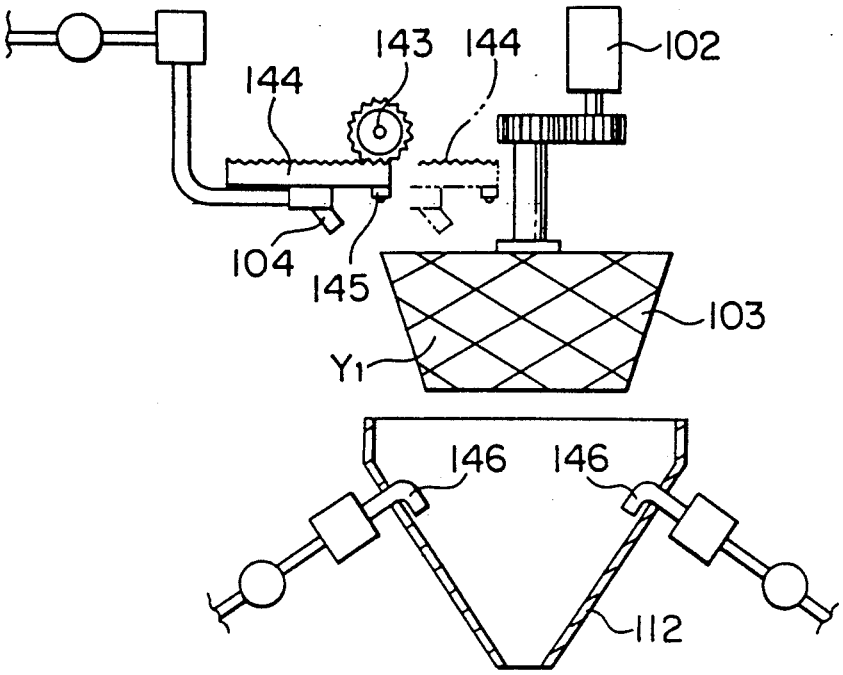

FIG. 17 shows a further modification in which a weft releasing blow nozzle 104 and a cheese diameter detector 145 constituted by a reflection type photoelectric sensor are fixedly mounted on a rack 144, which is adapted to be moved along the radial direction of the weft cheese 103 through a driving pinion 143. A motor (not shown) for rotating the pinion 143 is controlled on the basis of the cheese diameter information derived from the output of the cheese diameter detector 145. With this arrangement, the weft releasing blow nozzle 104 can always be disposed at an optimal position in the vicinity of the peripheral surface of the weft cheese 103, allowing the leading end $Y_{11}$ of the weft to be successfully detached from the weft cheese 103. Additionally, blow nozzles 146 may be installed so that the respective nozzle orifices thereof within the weft guide cover 112 are directed toward the smaller-diameter opening of the cover 112. With such an arrangement, the leading end $Y_{11}$ of the weft can be guided more positively or reliably to the weft length-measuring and reserving apparatus 106.

Figure 18:
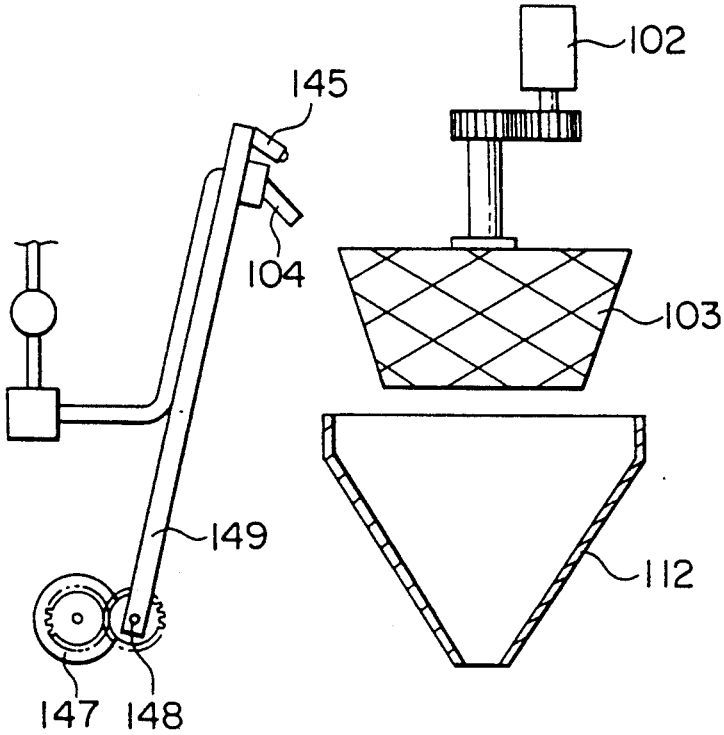

FIG. 18 shows a still further modification in which a weft releasing blow nozzle 104 and a cheese diameter detector 145 are mounted on an arm 149 at a free end portion thereof, which is rotatable about a supporting shaft 148 by an electric motor 147. This arrangement can assure substantially the same advantageous action and effects as those of the embodiment shown in FIG. 17 except that the weft releasing blow nozzle 104 and the cheese diameter detector 145 are angularly displaced around the supporting shaft 148. Parenthetically, the weft releasing blow nozzle 104 may be so arranged that it can move around the weft cheese along the peripheral surface thereof.

It is thought that the present invention will be understood from the foregoing description and it will be apparent that various changes may be made in the form, construction and arrangement thereof without departing from the spirit and scope of the invention or sacrificing all of its material advantages, the form hereinbefore described being merely preferred or exemplary embodiments thereof.

What is claimed is:

1. A weft processing apparatus in a jet loom including a weft supply having a peripheral surface around which a weft is wound, and means for measuring a length of weft fed from said weft supply and for reserving the measured weft therein, the weft length-measuring and reserving means having a weft introducing port to receive therein the weft fed from the weft supply, said apparatus comprising:

means for releasing the leading end of the weft from the peripheral surface of the weft supply;

means for jetting a fluid to move, by the jetted fluid, the weft leading end released by said releasing means to the weft introducing port of the weft length-measuring and reserving means; and means for guiding the weft leading end, which is moving toward the weft introducing port together with said jetted fluid from said fluid jetting means, into said weft introducing port.

2. A weft processing apparatus as set forth in claim 1, wherein said weft releasing means and said fluid jetting means are composed of a common blow nozzle device arranged so that the leading end of the weft is detached from said weft supply by blowing an air stream from said blow nozzle device onto the peripheral surface of the weft supply and the detached weft leading end is moved to the weft introducing port of the weft length-measuring and reserving mean by said air stream.

3. A weft processing apparatus as set forth in claim 2, wherein said guide means comprises a cover member for substantially surrounding a whole weft path extending between the weft supply and the weft introducing port.

4. A weft processing apparatus as set forth in claim 3, wherein said blow nozzle device is mounted adjacent a greater diameter peripheral surface portion of a weft cheese constituting said weft supply so that the axis of the jet from said blow nozzle device intersects with the axis of said weft cheese and forms a small angle with a peripheral surface of said weft cheese, whereby the peripheral surface of said weft cheese is swept by the fluid jetted from said blow nozzle device from the greater diameter peripheral surface portion to a smaller diameter peripheral surface portion of said weft cheese.

5. A weft processing apparatus as set forth in claim 4, said cover member generally being in the form of a cone having opposite open ends, wherein the greater diameter open end of said cover member is directed toward the smaller diameter side of said weft cheese, while the smaller diameter open end of said cover member is disposed opposite to said weft introducing port.

6. A weft processing apparatus as set forth in claim 5, wherein said blow nozzle device comprises a plurality of equispaced blow nozzles disposed around the greater diameter side periphery of said weft cheese.

7. A weft processing apparatus as set forth in claim 5, wherein said blow nozzle device comprises a plurality of spaced blow nozzles disposed in an array extending in the direction radially of said weft cheese.

8. A weft processing apparatus as set forth in claim 5, further comprising a movable brush disposed downstream of said blow nozzle device with respect to the direction of rotation of said weft cheese, and a cylinder connected to said brush for changing over said brush between a position where said brush is brought into contact with the peripheral surface of said weft cheese, and a position where said brush is away from the peripheral surface of said weft cheese.

9. A weft processing apparatus as set forth in claim 5, further comprising a driving pinion, a rack moved by said driving pinion in the direction radially of said weft cheese, and a cheese diameter detector mounted on said rack, wherein said blow nozzle device is mounted on said rack so as to be disposed at an optimal position close to the peripheral surface of said weft cheese by driving said driving pinion on the basis of information about the diameter of the weft cheese, said information being derived from the output of said cheese diameter detector.

10. A weft processing apparatus as set forth in claim 5, further comprising blow nozzles having blow nozzles installed within said cover member in such a disposition that said nozzle orifices are directed toward the smaller diameter open end of said cover member.

11. A weft processing apparatus as set forth in claim 5, further comprising an electric motor, an arm adapted to be rotated around a shaft supporting said arm by said electric motor, said arm having a free end portion extending to a position lying in the vicinity of said weft cheese, and a cheese diameter detector mounted on said arm at said free end portion thereof, said blow nozzle device being mounted on said arm, whereby said blow nozzle device can be disposed at an optimal position in the vicinity of the peripheral surface of said weft cheese by driving said electric motor in accordance with information about the cheese diameter, said information being derived from the output of said cheese diameter detector.

12. A weft processing apparatus as set forth in claim 1, wherein said weft releasing means comprises a suction means in the form of a suction pipe having an intake port for generating a suction air stream to suck the leading end of the weft therein.

13. A weft processing apparatus as set forth in claim 4, wherein said intake port is provided with means for congregating the weft leading end sucked in said intake port and temporarily holding the congregated weft.

14. A weft processing apparatus as set forth in claim 5, wherein said weft congregating and holding means is in the form of a net having a mesh structure.

15. A weft processing apparatus as set forth in claim 5, wherein said weft congregating and holding means is in the form of a brush.

16. A weft processing apparatus as set forth in claim 5, further including means for changing over said weft congregating and holding means between an operative position adjacent the weft supply in which said weft congregating and holding means receives the weft leading end, and a stand-by position, wherein when said weft congregating and holding means holding the congregated weft leading end is changed over to said stand-by position, said congregated weft leading end is moved to said weft introducing port by the fluid jetted from said fluid jetting means.

17. A weft processing apparatus as set forth in claim 8, wherein said guide means comprises a weft transporting guide having one end portion disposed adjacent said weft supply and the other end portion disposed adjacent said weft introducing port, at least said other end portion, which orthogonally intersects with the direction of the fluid flow jetted from said fluid jetting means, being opened.

18. A weft processing apparatus as set forth in claim 11, wherein a window is formed in said one end portion of said weft transporting guide which is generally aligned with said intake port; and further comprising means for movably mounting said suction pipe and said intake port of said suction pipe into and out of said window, and wherein said fluid jetting means is mounted on said weft transporting guide at said one end portion so as to direct said jetted fluid toward said other end portion of said weft transporting guide.

* * * * *

UNITED STATES PATENT AND TRADEMARK OFFICE

CERTIFICATE OF CORRECTION

PATENT NO. : 5,016,680

DATED : May 21, 1991

INVENTOR(S) : K. Mitsuya et al

It is certified that error appears in the above-identified patent and that said Letters Patent is hereby corrected as shown below:

Col. 7, line 18, after "or" insert --inlet--; line 33, change "sley" to --slay--; line 34, change "sley" to --slay--.

Col. 9, line 39, "placed" should read --place--.

Col. 11, line 58, "yl" should read --$Y_1$--.

Col. 13, line 15, after "therefore" insert comma --,--.

Col. 16, line 66, "mean" should read --means--.

Signed and Sealed this

Seventeenth Day of November, 1992

*Attest:*

DOUGLAS B. COMER

*Attesting Officer*

*Acting Commissioner of Patents and Trademarks*